US007669954B2

(12) United States Patent
Kojima et al.

(10) Patent No.: US 7,669,954 B2
(45) Date of Patent: Mar. 2, 2010

(54) LIQUID EJECTION APPARATUS AND RECORDING APPARATUS

(75) Inventors: Toshiya Kojima, Kanagawa-ken (JP); Gentaro Furukawa, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 176 days.

(21) Appl. No.: 12/035,456

(22) Filed: Feb. 22, 2008

(65) Prior Publication Data

US 2008/0211841 A1 Sep. 4, 2008

(30) Foreign Application Priority Data

Mar. 2, 2007 (JP) ..... 2007-053456

(51) Int. Cl.
*B41J 29/38* (2006.01)

(52) U.S. Cl. ..... 347/17; 347/14; 347/19; 347/85

(58) Field of Classification Search ..... 347/17
See application file for complete search history.

(56) References Cited

U.S. PATENT DOCUMENTS 5,701,149 A * 12/1997 Pagnon et al. ..... 347/89

FOREIGN PATENT DOCUMENTS

JP 55086760 A * 6/1980
JP 2004-106310 A 4/2004

* cited by examiner

*Primary Examiner*—Matthew Luu
*Assistant Examiner*—Brian J Goldberg
(74) *Attorney, Agent, or Firm*—Birch, Stewart, Kolasch & Birch, LLP

(57) ABSTRACT

The liquid ejection apparatus includes: a recording head which ejects an ejection liquid; a liquid container which accommodates air and the ejection liquid; a recording head connection flow channel which leads from the liquid container to the recording head; a pressure determination device which determines pressure of the ejection liquid accommodated in the liquid container; a first pressure supply device which drives a rotating body to remove or introduce the air from or to the liquid container so as to keep pressure of the air in the liquid container constant; a phase determination device which determines a phase of the rotating body; a second pressure supply device which is disposed in a pulsation suppressing flow channel that connects the liquid container with the recording head connection flow channel and which removes and introduces the ejection liquid from or to the liquid container; and a control device which controls rotation speed of the second pressure supply device in accordance with the phase of the rotating body determined by the phase determination device so as to cancel out variation of the pressure of the ejection liquid caused by the first pressure supply device.

4 Claims, 23 Drawing Sheets

FIG.6

| PHASE OF PRESSURE ADJUSTMENT PUMP | ROTATION SPEED (rps) OF PULSATION SUPPRESSING PUMP ("-" INDICATES REVERSE ROTATION) | |
|---|---|---|
| | DURING PRESSURIZING | DURING DEPRESSURIZING |
| 0° | −180 | +120 |
| 1° | −170 | +115 |
| 2° | −155 | +108 |
| 3° | −127 | +99 |
| ... | ... | ... |
| 359° | −175 | +119 |

LIQUID EJECTION APPARATUS AND RECORDING APPARATUS

BACKGROUND OF THE INVENTION

1. Field of the Invention

The present invention relates to a liquid ejection apparatus and a recording apparatus, and more particularly, to a liquid ejection apparatus in which pressure variation caused by the pulsating flow by a pump can be suppressed while maintaining the liquid refill volume and the responsiveness of pressure adjustment.

2. Description of the Related Art

Conventionally, in a liquid ejection apparatus, a negative pressure is applied to the liquid inside the nozzles, in order to prevent the liquid from leaking out from the nozzles when ejection is not being carried out. In order to apply such a negative pressure, a negative pressure generating chamber is provided, in an ink cartridge, an ink tank or a sub tank which is connected to the nozzles, in order to generate a negative pressure by adjusting the pressure through supplying and evacuating air by means of a pump. However, pumps generally have a pulsating action, and there is a possibility that pressure variation may occur due to the effects of this pulsating action during pressure adjustment.

Therefore, Japanese Patent Application Publication No. 2004-106310 discloses a proposal for avoiding pressure variation caused by the pulsating action of a pump. As shown in FIG. 19 and FIG. 20, in Japanese Patent Application Publication No. 2004-106310, a pressure variation suppressor 204 comprising a filter 205 of a porous body is disposed between the ink supply apparatus 202 and the recording head 203. The vibration occurring during the supply of ink is suppressed, thereby preventing the pressure variation occurring in the ink supply apparatus 202 from being transmitted to the recording head 203.

Firstly, the principles of the generation of a pulsating action by the pump will be described with reference to a rotary pump. As shown in FIG. 21, in a rotary pump, a rotating body 211 rotates and compresses an elastic tube 212 which is held by a guide 213, thereby causing the air inside the elastic tube 212 to move and creating an outflow and inflow of air.

FIG. 22 is an expanded diagram of the guide 213 and the elastic tube 212 shown in FIG. 21. As shown in FIG. 22, when the rotating body 211 moves in the order of A, B, C and D (i.e. A→B→C→D) illustrated in FIG. 21, the volume of the region $\alpha$ in the elastic tube 212 which is positioned in the direction of movement of the rotating body 211 is reduced and the pressure increases accordingly as the rotating body 211 advances in the order of A, B, C and D (i.e. A→B→C→D). When the rotating body 211 passes D and then reaches the subsequent position, A', as shown in the illustration indicated by (d) in FIG. 22, the rotating body 211 returns to the position of A, as shown in the illustration indicated by (a) in FIG. 22. In this case, the pressure in the elastic tube 212 affects the raised pressure at A' and after, and hence there is a decline in the pressure at and after A'.

Therefore, the relationship between the position (phase) of the rotating body 211 and the pressure value at the part that is subject to the air supply by the rotary pump is as represented in FIG. 23. As shown in FIG. 23, as the position (phase) of the rotating body 211 advances in the order of A, B, C and D (i.e. A→B→C→D), the pressure value at the part subject to the supply increases at a constant ratio, but when the position (phase) of the rotating body 211 passes D and returns again to A, then the value of the pressure at the part subject to the supply falls temporarily. The breadth of this temporary decrease in the pressure value at the part subject to the supply affects a pulsating action in the air supply operation performed by the rotary pump.

Here, if the volume of the elastic tube 212 from A→B→C→D→A' is taken to be v, and the volume from A' is taken to be V, then the breadth of the pulsating action is expressed by $N \times v^2/\{V \times (V+v)\}$, in other words, it is proportional to $v^2$ and inversely proportional to $V^2$. N is the number of repetitions. In order to make the apparatus compact in size, in particular, it is necessary to set the volume V of the part subject to the supply to a small volume, and in order to adapt to a large volume supply, it is necessary to set the volume v of the pump tube to a large volume. Therefore, the pulsating action becomes large and the pressure variation during pressure adjustment becomes large. Therefore, it is difficult to achieve the supply having a stable pressure. This is not limited to a rotary pump, and may also occur in the case of a piston type pump.

In the invention described in Japanese Patent Application Publication No. 2004-106310, the pressure variation caused by the pulsating action of the pump is suppressed by the porous filter as described above, but there is a possibility that the flow channel resistance is high, the response with respect to pressure adjustment is poor, and shortfall in the supply of liquid to the recording head may occur.

SUMMARY OF THE INVENTION

The present invention has been contrived in view of these circumstances, an object thereof being to provide a liquid ejection apparatus and a recording apparatus whereby pressure variation in a liquid container caused by the pulsating action of a pump can be suppressed while maintaining the responsiveness with respect to pressure adjustment in the liquid container.

In order to attain such an object described above, one aspect of the invention is directed to a liquid ejection apparatus comprising: a recording head which ejects an ejection liquid; a liquid container which accommodates air and the ejection liquid; a recording head connection flow channel which leads from the liquid container to the recording head; a pressure determination device which determines pressure of the ejection liquid accommodated in the liquid container; a first pressure supply device which drives a rotating body to remove or introduce the air from or to the liquid container so as to keep pressure of the air in the liquid container constant; a phase determination device which determines a phase of the rotating body; a second pressure supply device which is disposed in a pulsation suppressing flow channel that connects the liquid container with the recording head connection flow channel and which removes and introduces the ejection liquid from or to the liquid container; and a control device which controls rotation speed of the second pressure supply device in accordance with the phase of the rotating body determined by the phase determination device so as to cancel out variation of the pressure of the ejection liquid caused by the first pressure supply device.

In this aspect of the invention, since the pressure variation created by the first pressure supply device is cancelled out by controlling the rotation speed of the second pressure supply device in accordance with the determined phase of the rotating body of the first pressure supply device, then it is possible to suppress the pressure variation in the liquid container caused by the pulsating action of the first pressure supply device (such as pump), while maintaining the refill volume to the recording head and responsiveness of the pressure adjustment in the liquid container.

The rotating body is not limited to the rotor of a rotary pump, for example, and it may also include the plunger of a piston type pump, and the like.

Desirably, the liquid ejection apparatus further comprises a liquid amount detector which determines an amount of the ejection liquid accommodated in the liquid container, wherein the control device alters an amount of the ejection liquid removed from or introduced to the liquid container in accordance with the amount of the ejection liquid determined by the liquid amount detector to cancel out the variation of the pressure of the ejection liquid caused by the first pressure supply device.

In this aspect of the invention, since the pressure variation created by the first pressure supply device is cancelled out by altering the amount of ejection liquid removed from and introduced to the liquid container, in accordance with the amount of liquid determined by the liquid amount detector, then even if variation occurs in the pulsation of the pressure of the air layer, due to change in the amount of liquid in the liquid container, it is still possible to suppress the pressure variation in the liquid container caused by the pulsating action of the pump, while also maintaining the refill volume to the recording head and maintaining the responsiveness of the pressure adjustment in the liquid container.

Desirably, during not recording, the second pressure supply device is driven to circulate the ejection liquid through the liquid container, the recording head connection flow channel and the pulsation suppressing flow channel.

In this aspect of the invention, since the ejection liquid is circulated through the liquid container, the recording head connection flow channel and the pulsation suppressing flow channel even when not recording, then it is possible to prevent prolonged stagnation of the ejection liquid.

Another aspect of the invention is directed to a recording apparatus comprising any one of the liquid ejection apparatuses described above.

According to the present invention, it is possible to suppress pressure variation in the liquid container caused by the pulsating action of the first pressure supply device (such as pump), while maintaining the refill volume to the recording head and maintaining the responsiveness of the pressure adjustment in the liquid container.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 6 is a diagram showing a correlation table which relates the phase of the pressure adjustment pump and the rotation speed of the pulsation suppressing pump;

DETAILED DESCRIPTION OF THE PREFERRED EMBODIMENTS

Firstly, a first embodiment will be described.

First Embodiment

Figure 1:
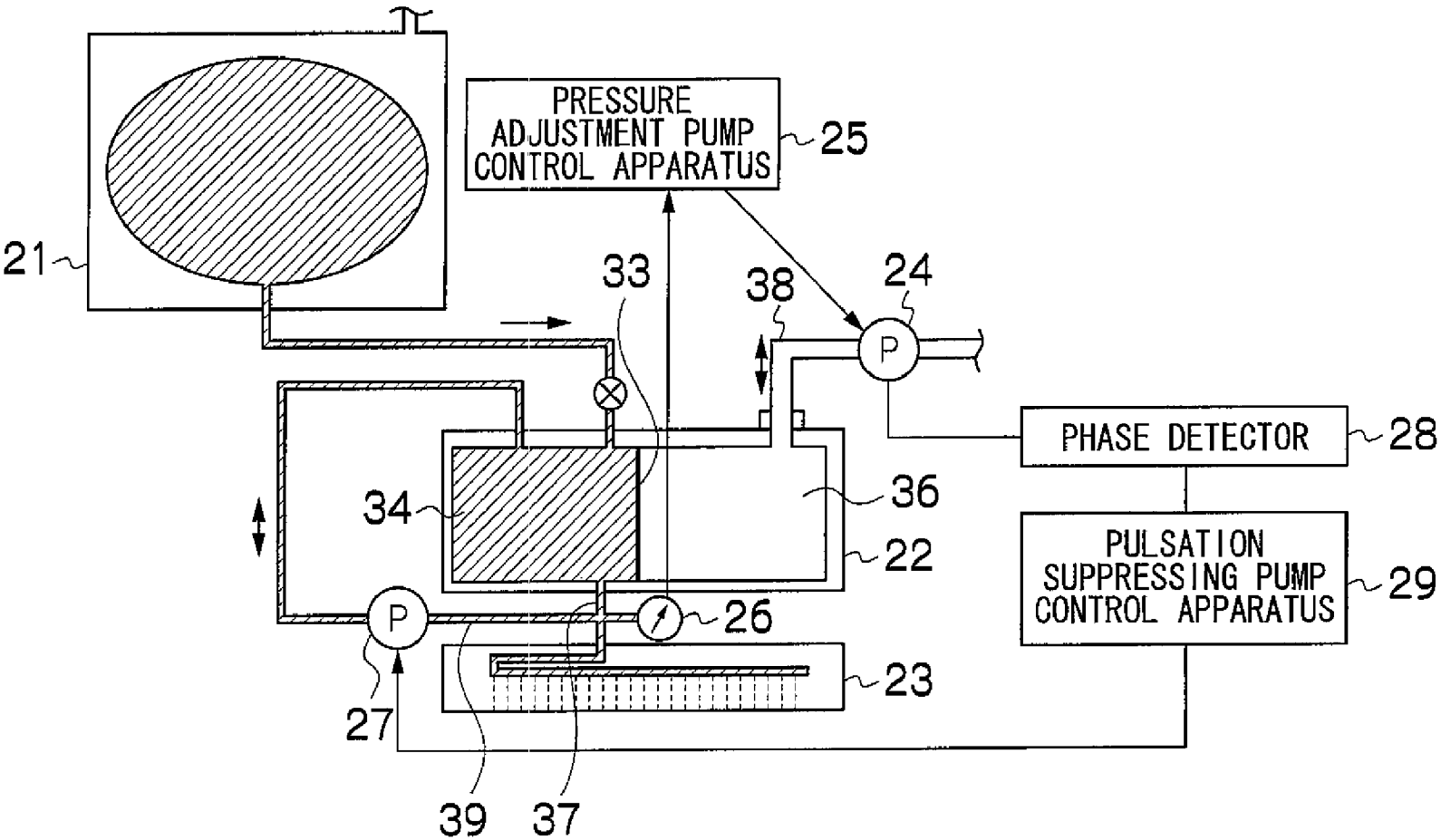
FIG. 1 is a general view of a liquid ejection apparatus according to an embodiment of the present invention.

Composition of Liquid Ejection Apparatus:

FIG. 1 is a general schematic diagram of a liquid ejection apparatus according to an embodiment of the present invention. As shown in FIG. 1, the liquid ejection apparatus 11 according to the present embodiment is constituted principally by a main tank 21 which stores ink, a sub tank 22 which temporarily stores ink supplied from the main tank 21, a recording head 23 which ejects ink supplied from the sub tank 22, and the like. The interior of the sub tank 22 is divided by a movable film 33 into an ink layer 34 and an air layer 36, and a pressure adjustment pump 24 for adjusting the pressure of the air layer 36 is provided in a pressure adjustment flow channel 38 which is connected to the air layer 36. Furthermore, a pressure gauge 26 is provided in the recording head flow channel 37 between the sub tank 22 and the recording head 23. A pressure adjustment pump control apparatus 25 is provided between the pressure adjustment pump 24 and the pressure gauge 26.

A pulsation suppressing flow channel 39 branches from the recording head flow channel 37, and the pulsation suppressing flow channel 39 is provided in such a manner that a portion of the ink supplied to the recording head connection flow channel 37 from the ink layer 34 of the sub tank 22 passes along the pulsation suppressing flow channel 39 and then is returned again to the ink layer 34 of the sub tank 22, so as to be circulated. A pulsation suppressing pump 27 is disposed in the pulsation suppressing flow channel 39.

A phase detector 28 and a pulsation suppressing pump control apparatus 29 are provided between the pressure adjustment pump 24 and the pulsation suppressing pump 27. The pulsation suppressing pump 27 uses a rotary pump in which a pulse motor is used as the source for driving the rotating body. By changing the pulse frequency of the pulse motor, the driving of the rotating body is controlled and hence the supply flow rate to the recording head 23 is controlled. One characteristic feature of a rotary pump is that it permits reverse flow more readily than a syringe pump, and a pulse motor has characteristic features that allow easy speed control and have good responsiveness in comparison with other motors. Furthermore, for similar reasons, it is also desirable to use a rotary pump employing a pulse motor in the pressure adjustment pump 24 also.

An origin point detector (not illustrated), for example, a detector which detects slits by means of an optical sensor, is provided in the pulse motor, and the phase is calculated by integrating the number of pulses from the point of origin and the step angle of the motor.

Action of Liquid Ejection Apparatus

Figure 2:
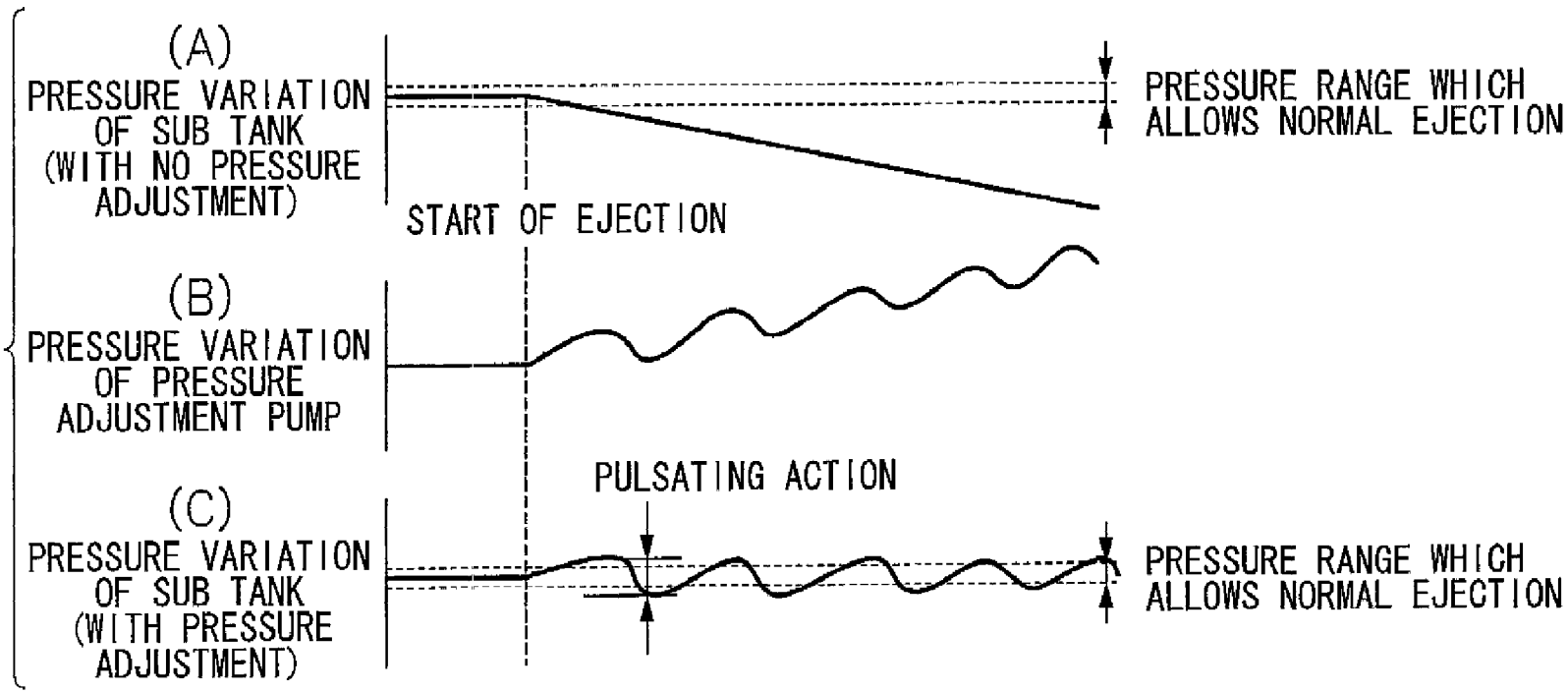
FIG. 2 is a diagram showing an aspect of pressure variation in a sub tank and a pressure adjustment pump.

The action of the liquid ejection apparatus according to the present embodiment having the composition described above will now be described. Firstly, an overview of the action of the liquid ejection apparatus according to the present embodiment will be described. During ejection of ink, the state of the pressure in the ink layer 34 of the sub tank 22 of the liquid ejection apparatus 11 and the pressure in the pressure adjustment pump 24 are as shown in FIG. 2 including graphs indicated by (A), (B) and (C) where the vertical axes represent pressure and the horizontal axes represent time. As shown in (A) of FIG. 2, the pressure of the air layer 36 in the sub tank 22 gradually declines as ink is ejected from the recording head 23. Therefore, with the passage of time, as shown in (B) of FIG. 2, the pressure of the air layer 36 in the sub tank 22 is adjusted by the pressure adjustment pump 24 which varies and increases the supply pressure.

In so doing, as shown in (C) of FIG. 2, the pressure of the air layer 36 in the sub tank 22 is kept within a uniform range. However, as described above, due to the pulsating action of the pressure adjustment pump 24, a pressure variation occurs in the air layer 36 inside the sub tank 22, and a phenomenon occurs whereby the breadth of this pressure variation goes outside the range in which normal ejection from the recording head 23 is possible.

Therefore, in the present embodiment, the phase and the direction of rotation of the pressure adjustment pump 24 are determined by the phase detector 28, and the pulsation of the pressure adjustment pump 24 is cancelled out by controlling the pulsation suppressing pump 27 by means of the pulsation suppressing pump control apparatus 29. In this case, the situation of the pressure variations in the sub tank 22, the pressure adjustment pump 24 and the pulsation suppressing pump 27 is as shown in FIG. 3 including graphs indicated by (A), (B), (C) and (D) where the vertical axes represent pressure and the horizontal axes represent time.

Figure 3:
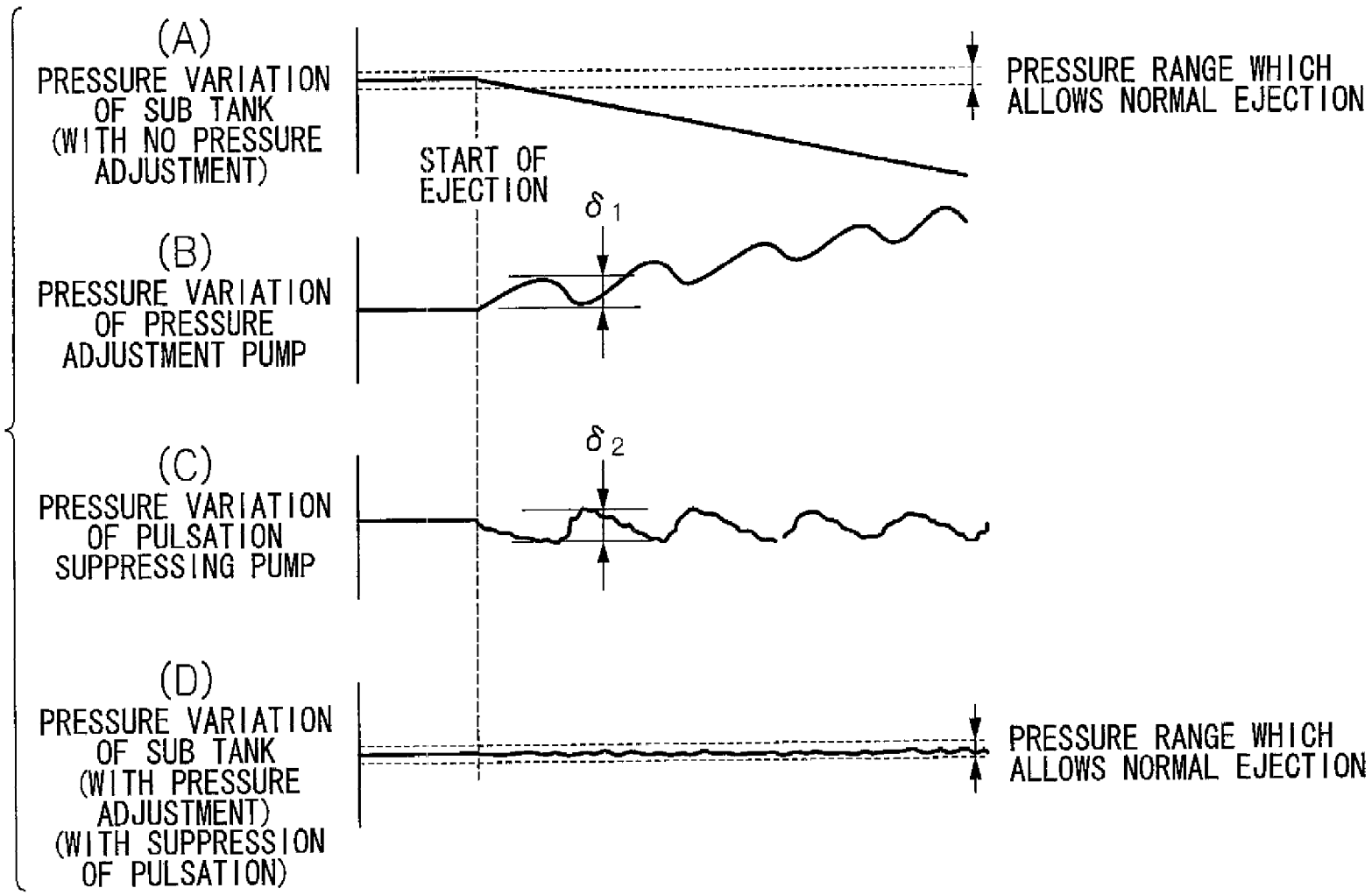
FIG. 3 is a diagram showing an aspect of pressure variation in a sub tank, a pressure adjustment pump and a pulsation suppressing pump.

As shown in (A) of FIG. 3, the pressure of the air layer 36 inside the sub tank 22 gradually declines as ink is ejected from the recording head 23. Therefore, with the passage of time, as shown in (B) of FIG. 3, the pressure of the air layer 36 inside the sub tank 22 is adjusted by the pressure adjustment pump 24 which varies and increases the supply pressure. Up to this point, the action is similar to that in FIG. 2 described above.

However, in FIG. 3, the following details are different to the case shown in FIG. 2. As shown in (C) of FIG. 3, the pulsation suppressing pump 27 is controlled in such a manner that the amplitude $\delta_2$ and cycle of the time axis wave (waveform) of the value of the pressure supplied to the ink layer 34 inside the sub tank 22 by the pulsation suppressing pump 27 are is equal to the amplitude $\delta_1$ (pulsation width) and cycle of the time axis wave (waveform) of the value of the pressure when the pressure adjustment pump 24 supplies air to the air layer 36 in the sub tank 22. In other words, the pulsation suppressing pump 27 is controlled in such a manner that the time axis wave (waveform) of the value of the pressure when the pulsation adjustment pump 24 supplies air to the air layer 36 in the sub tank 22 and the time axis wave (waveform) of the value of the pressure when the pulsation suppressing pump 27 supplies ink to the ink layer 34 inside the sub tank 22 cancel each other out when they are mutually superimposed.

Therefore, if the pressure of the air layer 36 in the sub tank 22 is adjusted by means of the pulsation suppressing pump 27 in this way, then as shown in (D) of FIG. 3, the pressure change in the air layer 36 inside the sub tank 22 can be kept within the range where normal ejection of ink is possible from the recording head 23. Consequently, it is possible to suppress the pressure variation inside the sub tank 22 caused by the pulsating action of the pressure adjustment pump 24, while also maintaining the refill volume to the recording head 23 and maintaining the responsiveness of the pressure adjustment inside the sub tank 22.

Figure 4:
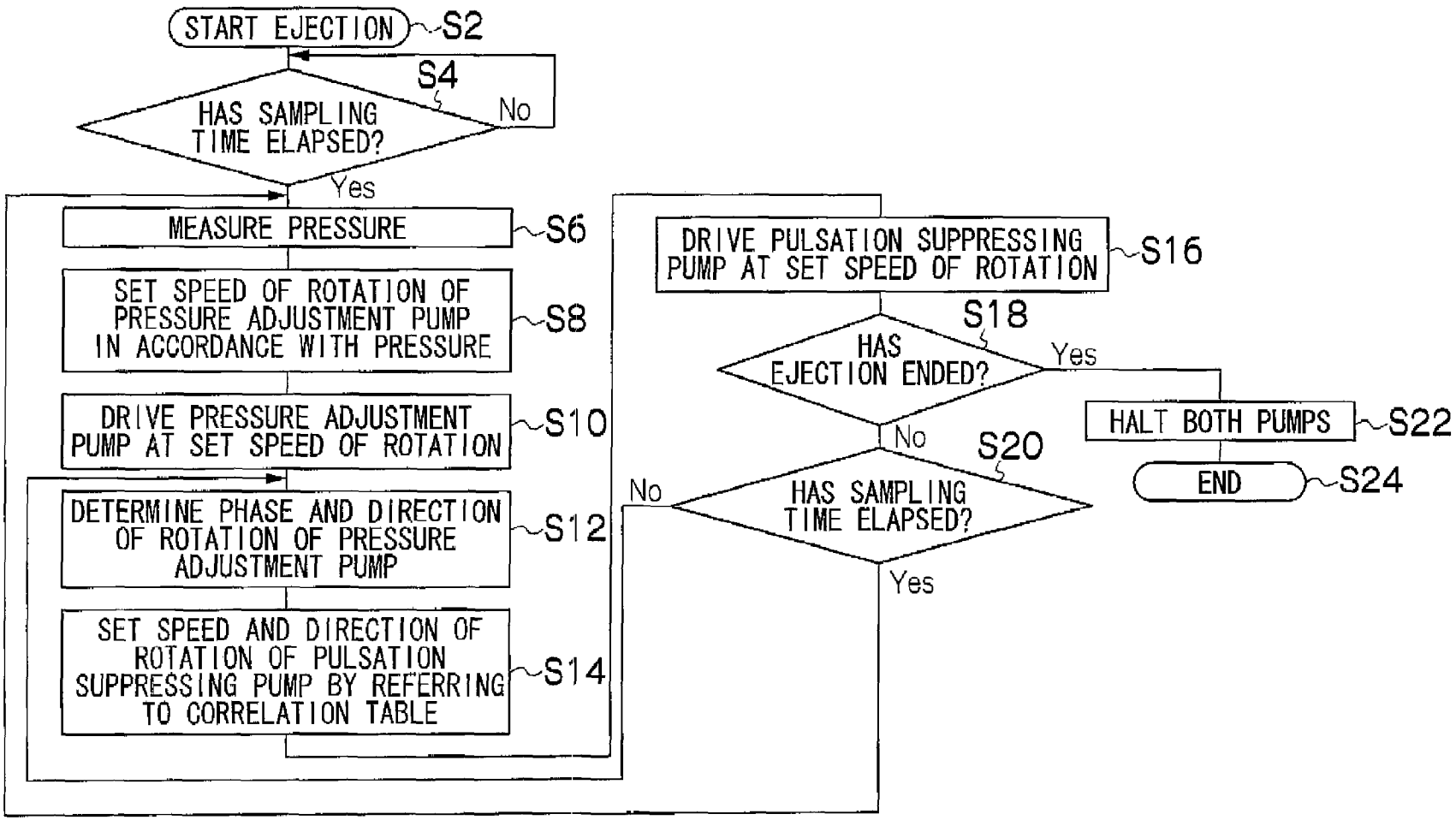
FIG. 4 is a diagram showing a sequence of controlling the pulsation of the pressure adjustment pump according to a first embodiment.
Figure 5:
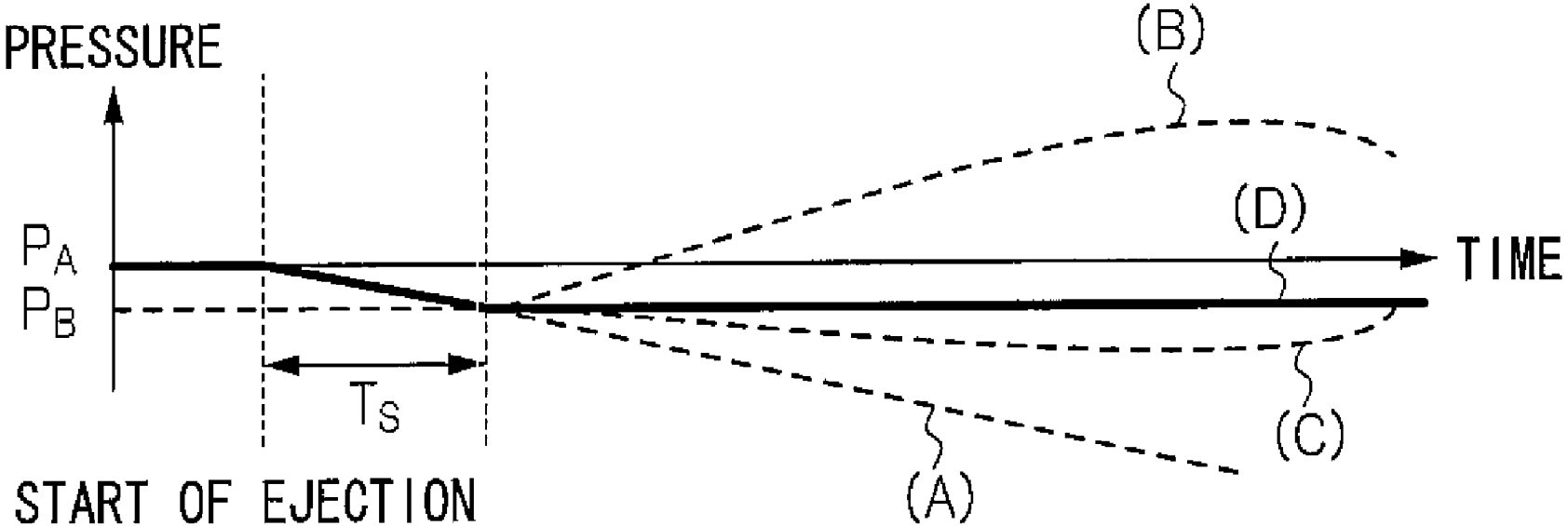
FIG. 5 is a diagram showing an aspect of pressure variation in the ink layer in a sub tank.

Next, the action of the liquid ejection apparatus according to the present embodiment will be described more specifically, with reference to the flowchart in FIG. 4 and the diagram in FIG. 5, which shows an aspect of the pressure variation in the recording head flow channel 37, in other words, with respect to the pressure gauge 26. As shown in FIG. 4, after starting ejection (step S2), a sampling time where no pressure adjustment is carried out, is provided (step S4). In so doing, as shown in FIG. 5, during the sampling time, the ink of the ink layer 34 in the sub tank 22 is supplied to the recording head 23, and the pressure of the ink layer 34 in the sub tank 22 gradually decreases. The sampling time is a period of time that is sufficiently shorter than the cycle of the pulsating action of the pressure supplied by the pressure adjustment pump 24. For example, if the cycle of the pulsating action of the pressure supplied by the pressure adjustment pump 24 is 1 sec, then the sampling time is set to 20 msec.

If ejection is continued in this state, then the pressure of the ink layer 34 in the sub tank 22 gradually declines, as shown by the dotted line (A) in FIG. 5. Therefore, after the sampling time has elapsed, the pressure of the ink layer 34 in the sub tank 22 is measured by the pressure gauge 26 (step S6). The rotation speed of the pressure adjustment pump 24 is set in accordance with the measured value of the pressure in such a manner that the pressure returns to the initial value of $P_A$ (step S8), and the pressure adjustment pump 24 is driven at this set rotation speed (step S10). The amount of change in the pressure caused by the pressure adjustment pump 24 in this case is indicated by the dotted line (B) in FIG. 5.

Here, the method of determining the rotation speed to be set will be described.

If the pressure changes from $P_A$ to $P_B$ in the sampling time $T_S$, then taking the volume of the air layer 36 at $P_A$ to be $V_A$, and taking the flow rate when the pump has rotated once to be S, then the number n of revolutions of the pressure adjustment pump 24 at the set rotation speed is determined by $n=(1-P_A/P_B)\times(V_A/S)\times(1/Ts)$.

Returning again to the sequence shown in FIG. 4, the phase and the direction of rotation of the rotating body of the pressure adjustment pump 24 are determined by the phase detector 28 (step S12). Thereupon, the rotation speed and the direction of rotation of the pulsation suppressing pump 27 are set, by referring to a correlation table which relates the phase and the direction of rotation of the pressure adjustment pump 24 with the rotation speed and the direction of rotation of the pulsation suppressing pump 27 (see FIG. 6 described hereinafter) (step S14), and the pulsation suppressing pump 27 is driven at the set rotation speed and direction of rotation (step S16). The amount of change in the pressure caused by the pulsation suppressing pump 27 in this case is indicated by the dotted line (C) in FIG. 5.

Consequently, the decrease in the pressure of the ink layer 34 in the sub tank 22 caused by ejection of ink (dotted line (A) in FIG. 5), the pressurization caused by the pressure adjustment pump 24 (dotted line (B) in FIG. 5), and the correction of the pulsating action of the pressure adjustment pump 24 caused by the pulsation suppressing pump 27 (dotted line (C) in FIG. 5) are superimposed on each other, and the pressure measured by the pressure gauge 26 is maintained at a desired constant value, as indicated by the solid line (D) in FIG. 5.

Here, the correlation table used at step S14 will be described.

Figure 7:
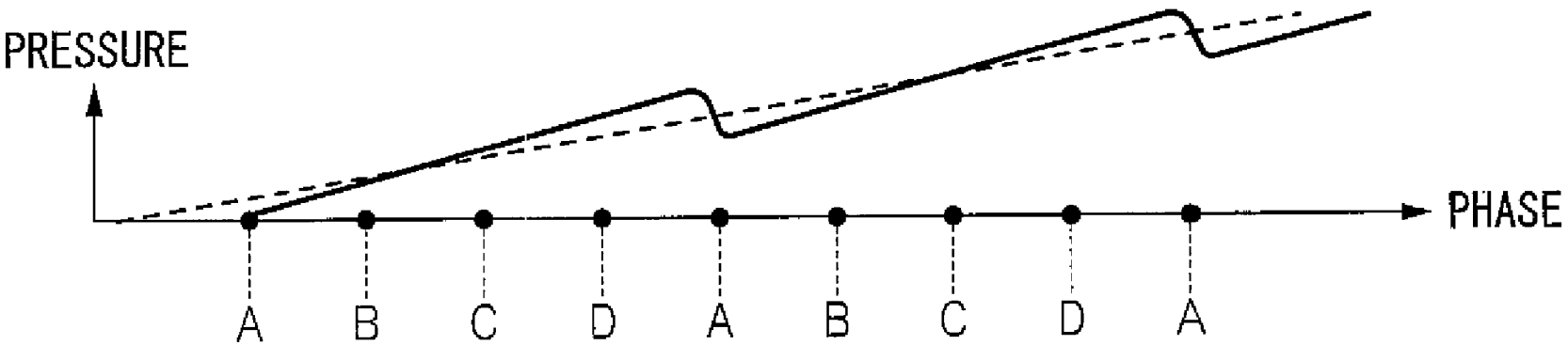
FIG. 7 is a diagram showing an aspect of an acquired pressure value and an average pressure value obtained by calculation.

As shown in FIG. 6, the correlation table used at step S14 provides a rotation speed and a direction of rotation of the pulsation suppressing pump 27, for each phase of the pressure adjustment pump 24 and both of the directions of rotation (during the pressurizing and depressurizing). When creating this correlation table, firstly, the supply of ink from the main tank 21 is halted, the ejection of ink from the recording head 23 is halted, and the pulsation suppressing pump 27 is also set to a halted state. In this state, the pressure adjustment pump 24 is caused to rotate at a constant rotation speed, and the pressure value is measured by the pressure gauge 26 at each of the phases (positions A, B, C and D in FIG. 7). The actually measured pressure value is indicated by the solid line in FIG. 7. On the other hand, the dotted line in FIG. 7 indicates the pressure value averaged by calculation for each of the phases of the pressure adjustment pump 24.

Figure 8:
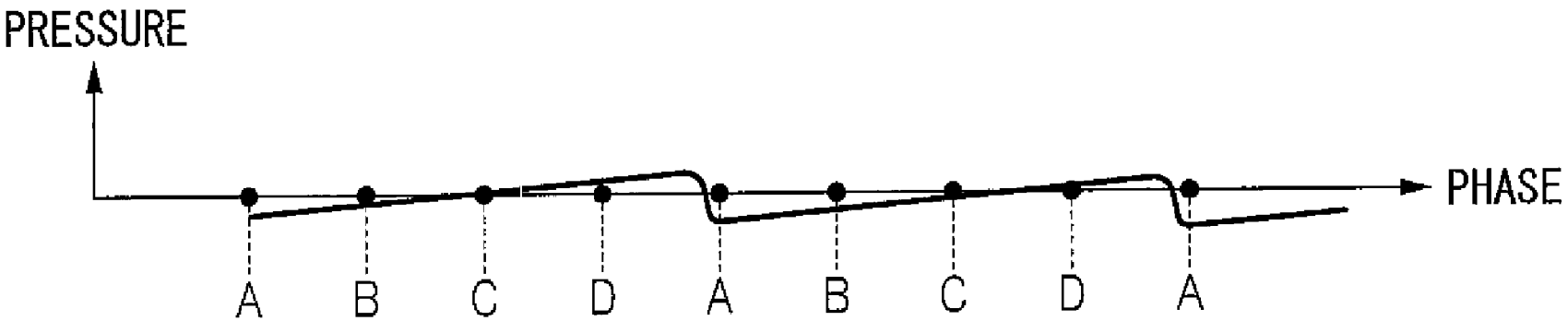
FIG. 8 is a diagram showing the differential value between the acquired pressure value and the average pressure value obtained by calculation.

If the differential between the actually measured pressure value and the calculated pressure value is derived as the breadth of the pressure variation caused by the pulsation of the pressure adjustment pump 24, then it can be expressed as shown in FIG. 8. Moreover, by deriving therefrom the rotation speed required in the pulsation suppressing pump 27, in respect of the differential between the measured pressure value and the average pressure value derived by calculation, a table of correlations between the phase of the pressure adjustment pump 24 shown in FIG. 6 and the rotation speed of the pulsation suppressing pump 27 is created.

Next, the method of controlling the pulsation suppressing pump 27 by means of the pulsation suppressing pump control apparatus 29 when driving the pulsation suppressing pump 27 at the speed and direction of rotation set at step S16 will be described.

Figure 9:
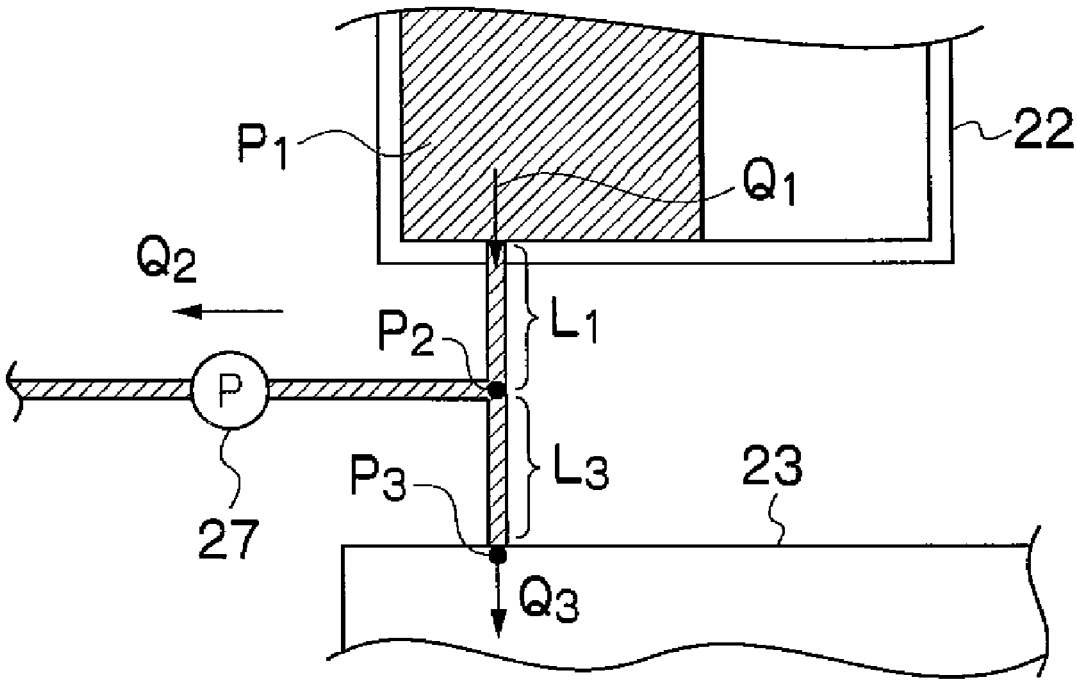
FIG. 9 is a diagram showing a method of controlling the pulsation suppressing pump.

As shown in FIG. 9, for example, the pressure of the ink in the sub tank 22 in a state where the pressure adjusting pump 24 (not illustrated) is operating is taken as $P_1$, and a case where $P_1$ is higher than the pressure range which allows normal ejection is considered. In order to simplify the description, the pressure gauge 26 is omitted from the illustration in FIG. 9.

In FIG. 9, taking the flow rate of the ink from the sub tank 22 to be $Q_1$, taking the flow rate of the ink in the pulsation suppressing pump 27 to be $Q_2$ and taking the flow rate of the ink to the recording head 23 to be $Q_3$, the relationship $Q_1=Q_2+Q_3$ is established. If the flow channel resistance in the flow channel which leads from the sub tank 22 to the recording head 23, is uniform, then taking the pressure at the branching point of the flow channel to be $P_2$, taking the length of the flow channel from the sub tank 22 to the branching point to be $L_1$, taking the pressure in the recording head 23 to be $P_3$, and taking the length of the flow channel from the branching point to the recording head 23 to be $L_3$, then the relationships $P_2=P_1-k\times L_1\times Q_1$ and $P_3=P_2-k\times L_3\times Q_3$ are established. Here k is a coefficient.

From the equations described above, the equation $P_3=P_1-k\times L_1\times Q_2-k\times(L_1+L_3)\times Q_3$ is derived. Similarly, considering a case where $P_1$ is lower than the pressure range which allows normal ejection, the pulsation suppressing pump 27 is driven in reverse, and the equation $P_3=P_1+k\times L_1\times Q_2-k\times(L_1+L_3)\times Q_3$ is derived. Consequently, if the value of k is acquired in advance, then the pressure $P_3$ of the recording head 23 is maintained at a desired constant value by controlling the flow rate $Q_2$ through controlling the speed and direction of rotation of the pulsation suppressing pump 27 by means of the pulsation suppressing pump control apparatus 29. Consequently, the pressure $P_3$ of the recording head 23 can be maintained at a desired constant value.

When ink is not being ejected form the recording head 23 (when not recording), it is possible to circulate the ink inside the connected flow channel to the ink inside the sub tank 22, by driving the pulsating suppressing pump 27. Therefore, it is possible to prevent stagnation of the ink over a long period of time.

Returning again to the sequence shown in FIG. 4, it is subsequently selected whether or not to end ejection (step S18), and if ejection is not ended ("No" verdict in step S18), then a sampling time is provided again (step S20). Before the sampling time has elapsed ("No" verdict in step S20), the procedure returns to step S12, and the sequence of the following steps is repeated: the phase and direction of rotation of the rotating body of the pressure adjustment pump 24 are determined by the phase detector 28 (step S12), the speed and direction of rotation of the pulsation suppressing pump 27 are set by referring to the correlation table which relates to the phase and direction of rotation of the pressure adjustment pump 24 and the speed and direction of rotation of the pulsation suppressing pump 27 (step S14), and the sequence (step 816) in which the pulsation suppressing pump 27 is driven at the set speed and direction of rotation is repeated. Thereupon, after the sampling time has elapsed ("Yes" verdict in step S20), the procedure returns to step S6, and the sequence (step S6 to step S18) is repeated.

On the other hand, if ejection has ended ("Yes" verdict in step S18), then both the pressure adjustment pump and the pulsation suppressing pump are halted (step S22), and ejection is terminated (step S24).

Second Embodiment

Next, the second embodiment will be described.

Composition of Liquid Ejection Apparatus

Figure 10:
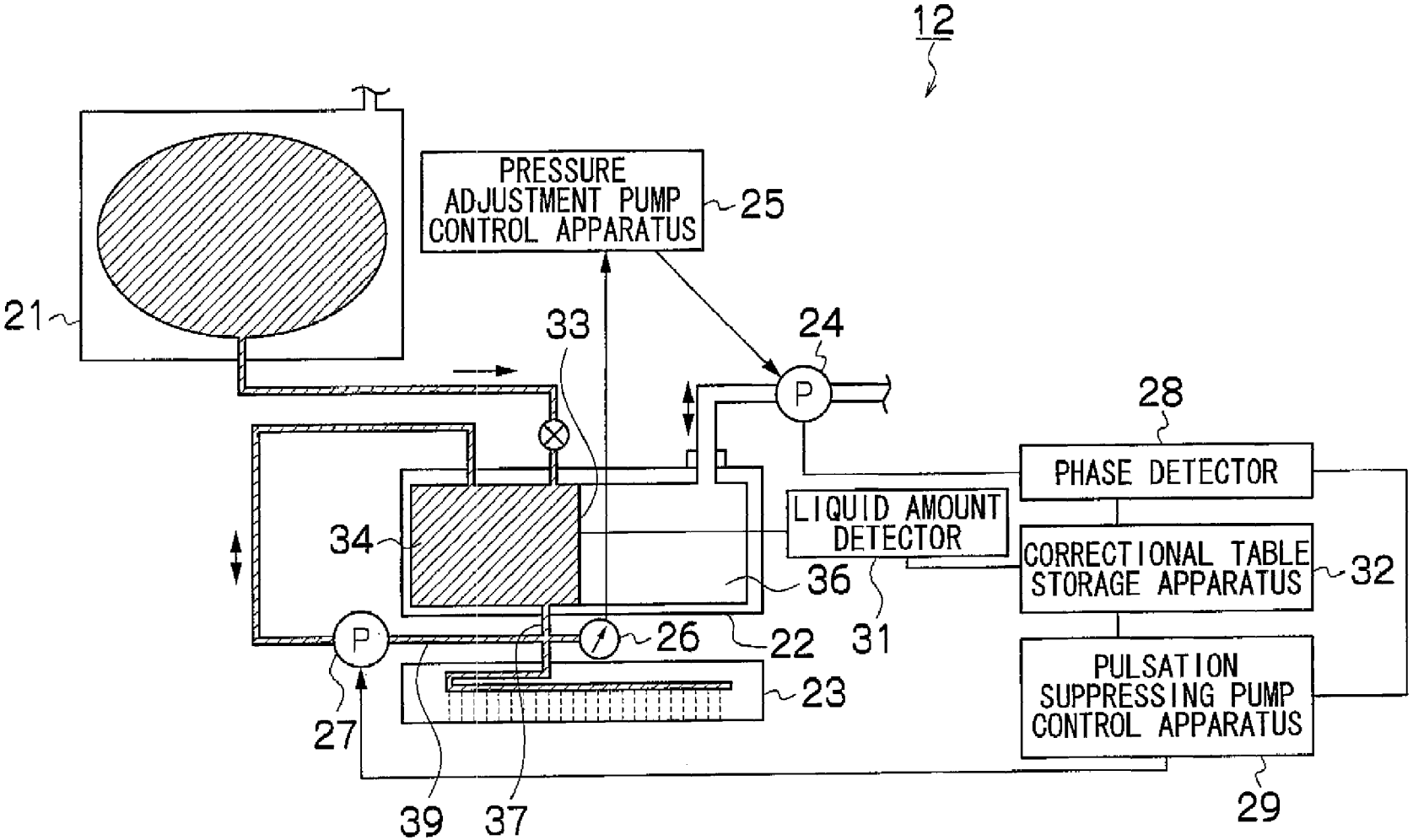
FIG. 10 is a schematic drawing of the liquid ejection apparatus according to a second embodiment of the present invention.

FIG. 10 is a schematic drawing of the liquid ejection apparatus 12 according to a second embodiment of the present invention. As shown in FIG. 10, the liquid ejection apparatus 12 according to the second embodiment differs from the liquid ejection apparatus 11 according to the first embodiment in that it comprises a liquid amount detector 31 and a correctional table storage apparatus 32. The liquid amount detector 31 is a detector which determines the amount of ink inside the sub tank 22, and it uses a laser displacement meter or density detector, or the like.

Furthermore, the correctional table storage apparatus 32 is an apparatus which stores a correctional table that is used in changing the amplitude of the output wave (waveform) of the pressure supplied by the pulsation suppressing pump 27, and controls the driving of the pulsation suppressing pump 27 in accordance with the amount of ink in the sub tank 22. Data indicating the relationship between the value of the liquid amount detector 31 and the amount of ink in the sub tank 22 (or the amount of air in the sub tank 22) is gathered in advance, and this data is stored in a storage apparatus (not illustrated) as a correctional table.

If the amount of ink in the sub tank 22 decreases and the volume of the air layer 36 increases, then the effect (amplitude) of the pulsating action by the pressure adjustment pump 24 becomes less. On the other hand, if the amount of ink inside the sub tank 22 increases and the volume of the air layer 36 decreases, then the effect (amplitude) of the pulsating action caused by the pressure adjustment pump 24 becomes greater. In this way, the effect (amplitude) of the pulsating action created by the pressure adjustment pump 24 varies with the amount of ink 34 (air layer 36) in the sub tank 22. Therefore, the amount of ink in the sub tank 22 is determined by means of the liquid amount detector 31, and the pulsation suppressing pump 27 is controlled on the basis of the correctional table stored in the correctional table storage apparatus 32 in accordance with the amount of ink thus determined.

Action of Liquid Ejection Apparatus

Figure 11:
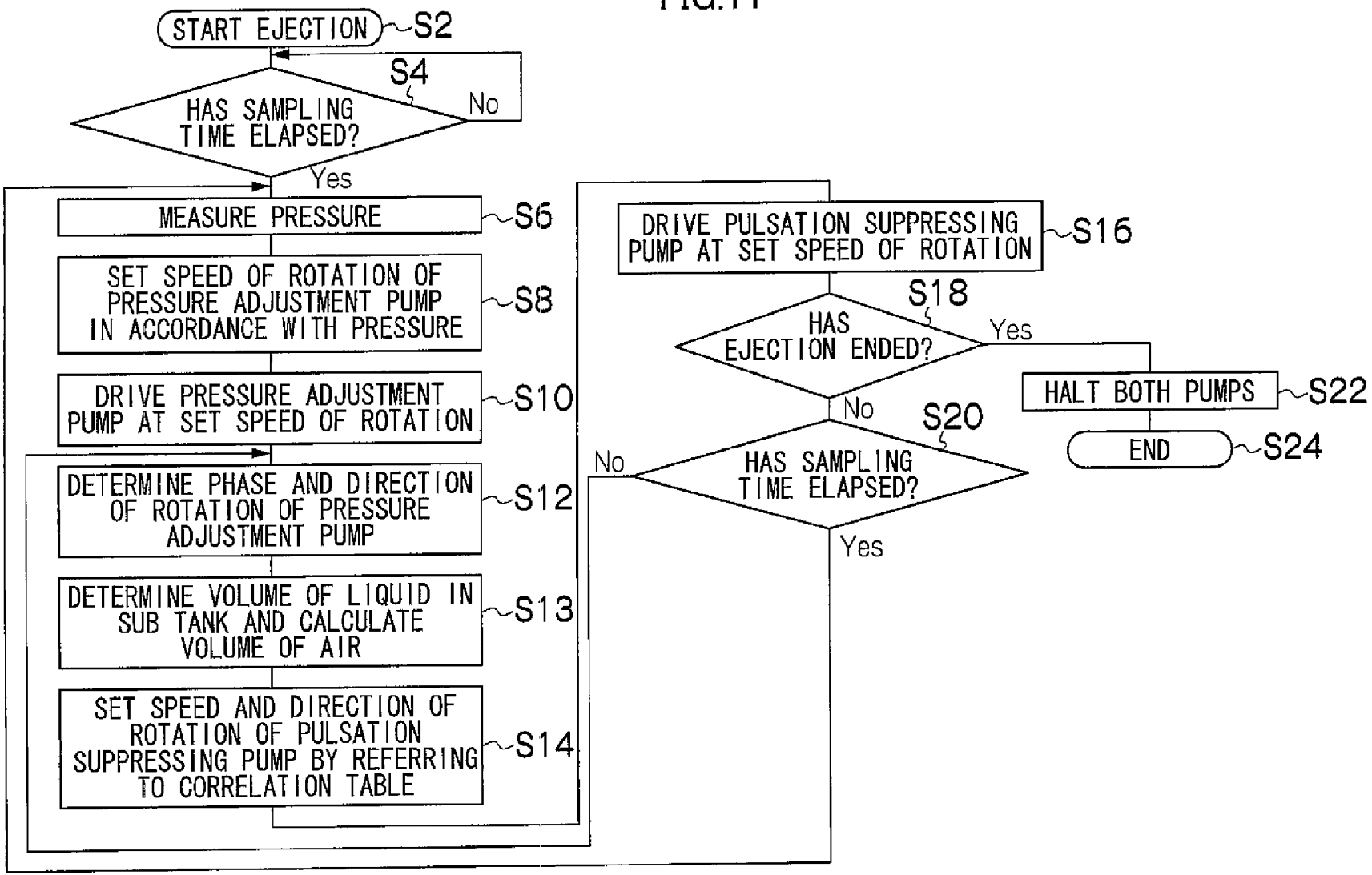
FIG. 11 is a diagram showing a sequence of controlling the pulsation of the pressure adjustment pump according to the second embodiment.

FIG. 11 shows an operating sequence of the liquid ejection apparatus 12 according to the second embodiment. As shown in FIG. 11, in the liquid ejection apparatus 12 according to the second embodiment, compared to the sequence in FIG. 4, a process of calculating the amount of air by determining the amount of ink in the sub tank 22 is added as step S13.

Figure 12:
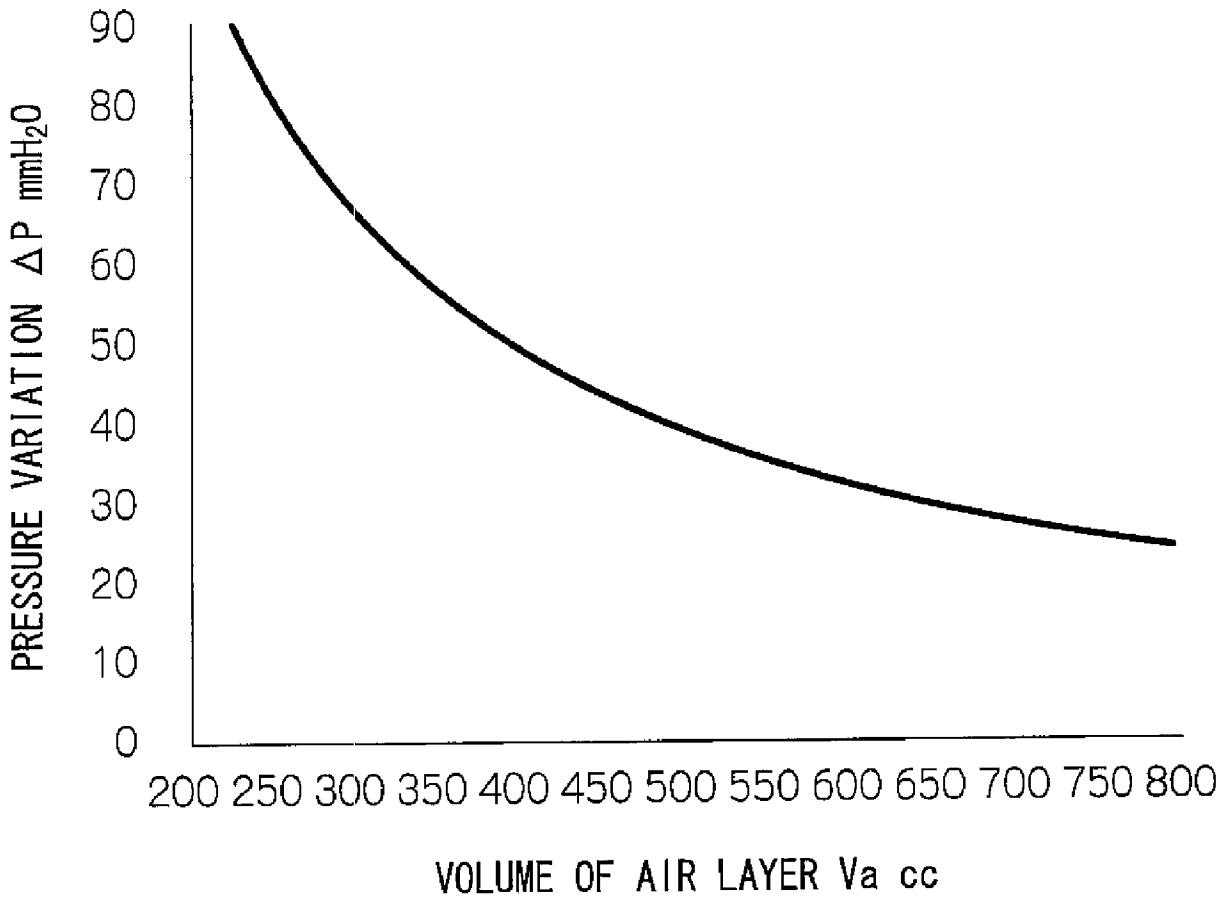
FIG. 12 is a diagram showing the relationship between the pulsation of the pressure adjustment pump and the volume of the air layer in the sub tank.

Here, the relationship $\Delta p \times Va = m$ is established between the pulsation $\Delta p$ by the pressure adjustment pump 24 and the volume Va of the air layer 36 of the sub tank 22, as shown in FIG. 12, when the pressure is constant. In this equation, "m" is a constant. Therefore, the value of m is stored in advance, the amount of ink in the sub tank 22 is determined by means of the liquid amount detector 31, and the volume Va of the air layer 36 of the sub tank 22 is determined, and is multiplied (m/Va) by using the table in FIG. 6 to carry out correction.

As described above, it is possible to correct the pulsating action more accurately by controlling the pulsation suppressing pump 27 in accordance with the amount of liquid inside the sub tank 22.

The method of controlling the pulsation suppressing pump 27 by means of the pulsation suppressing pump control apparatus 29 is the same as that of the first embodiment.

Common Composition of First Embodiment and Second Embodiment

Composition of Inkjet Recording Apparatus:

Next, an inkjet recording apparatus is described as a concrete example of the application of the liquid ejection apparatus described above.

Figure 13:
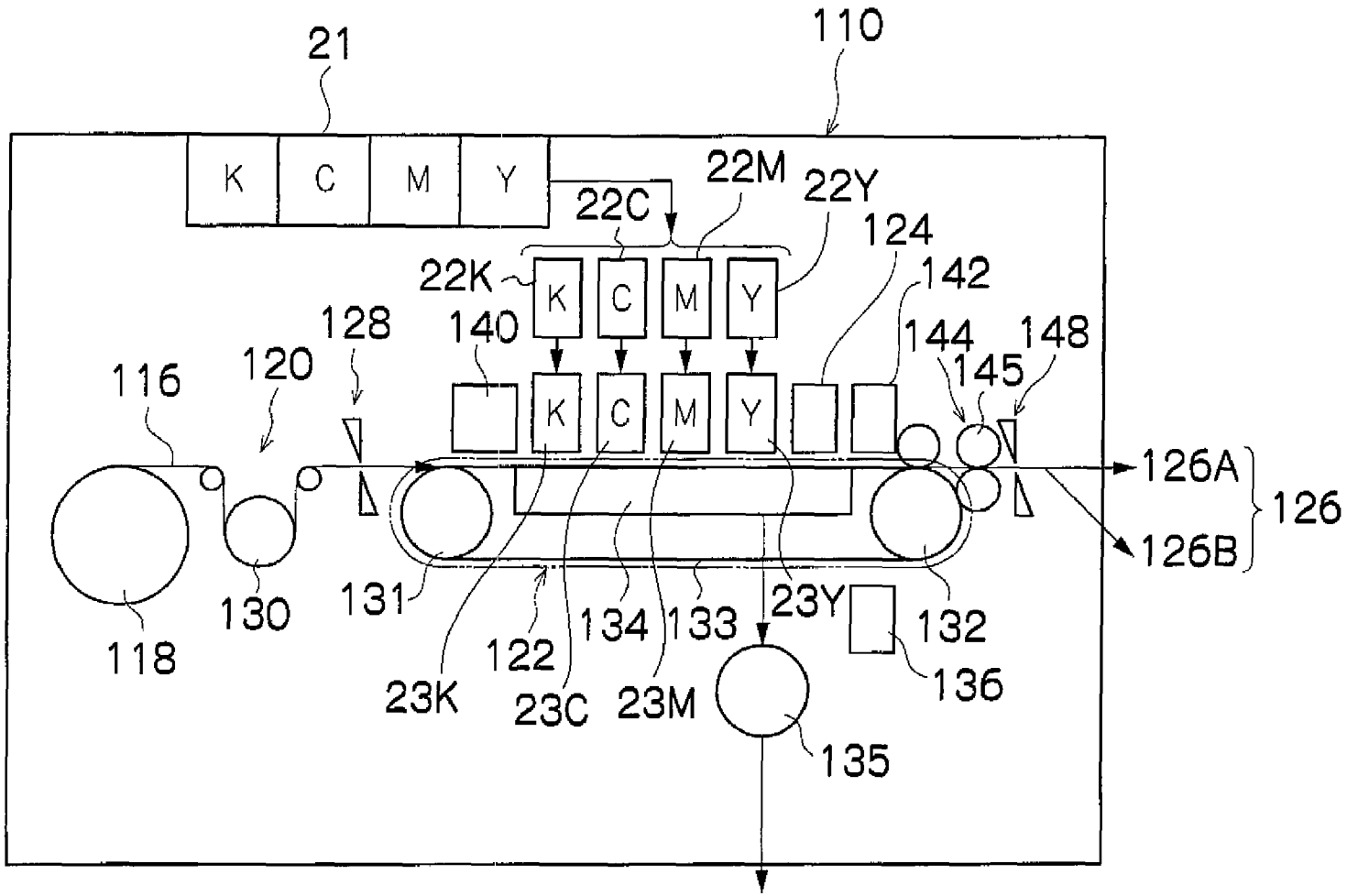
FIG. 13 is a general schematic drawing of an inkjet recording apparatus having a liquid ejection apparatus according to an embodiment of the present invention.

FIG. 13 is a general configuration diagram of an inkjet recording apparatus showing an embodiment of an image recording apparatus according to an embodiment of the present invention. As shown in FIG. 13, the inkjet recording apparatus 110 comprises: a plurality of inkjet recording heads 23K, 23C, 23M, and 23Y provided for ink colors of black (K), cyan (C), magenta (M), and yellow (Y), respectively; a sub tanks 22K, 22C, 22M, and 22Y for temporarily storing inks to be supplied to the inkjet recording heads 23K, 23C, 23M, and 23Y; a main tank 21 for storing inks to be supplied to the recording head sub tanks 22K, 22C, 22M, and 22Y; a paper supply unit 118 for supplying recording paper 116 which is a recording medium; a decurling unit 120 for removing curl in the recording paper 116; a belt conveyance unit 122 disposed facing the nozzle face (ink ejection face) of the recording heads 23K, 23C, 23M, and 23Y, for conveying the recording paper 116 while keeping the recording paper 116 flat; a print determination unit 124 for reading the printed result produced; and a paper output unit 126 for outputting image-printed recording paper (printed matter) to the exterior.

The main tank 21 has ink tanks for storing the inks of K, C, M and Y to be supplied to the sub tanks 22K, 22C, 22M, and 22Y, and the tanks are connected to the recording heads 23K, 23C, 23M, and 23Y by means of sub tanks 22K, 22C, 22M, and 22Y. The main tank 21 has a warning device (for example, a display device or an alarm sound generator) for warning when the remaining amount of any ink is low, and has a mechanism for preventing loading errors among the colors.

In FIG. 13, a magazine for rolled paper (continuous paper) is shown as an example of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (medium) can be used, it is preferable that an information recording medium such as a bar code or a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 13, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the recording heads 23K, 23C, 23M, and 23Y, and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the recording heads 23K, 23C, 23M, and 23Y on the interior side of the belt 133, which is set around the rollers 131 and 132, as shown in FIG. 13. The suction chamber 134 provides suction with a fan 135 to generate a negative pressure, and the recording paper 116 is held on the belt 133 by suction. It is also possible to use an electrostatic attraction method, instead of a suction-based attraction method.

The belt 133 is driven in the clockwise direction in FIG. 13 by the motive force of a motor being transmitted to at least one of the rollers 131 and 132, which the belt 133 is set around, and the recording paper 116 held on the belt 133 is conveyed from left to right in FIG. 13.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, examples thereof include a configuration in which the belt 133 is nipped with cleaning rollers such as a brush roller or a water absorbent roller, an air blow configuration in which clean air is blown onto the belt 133, and a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus 110 can comprise a roller nip conveyance mechanism, instead of the belt conveyance unit 122. However, there is a drawback in the roller nip conveyance mechanism in that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the recording heads 23K, 23C, 23M, and 23Y in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 14:
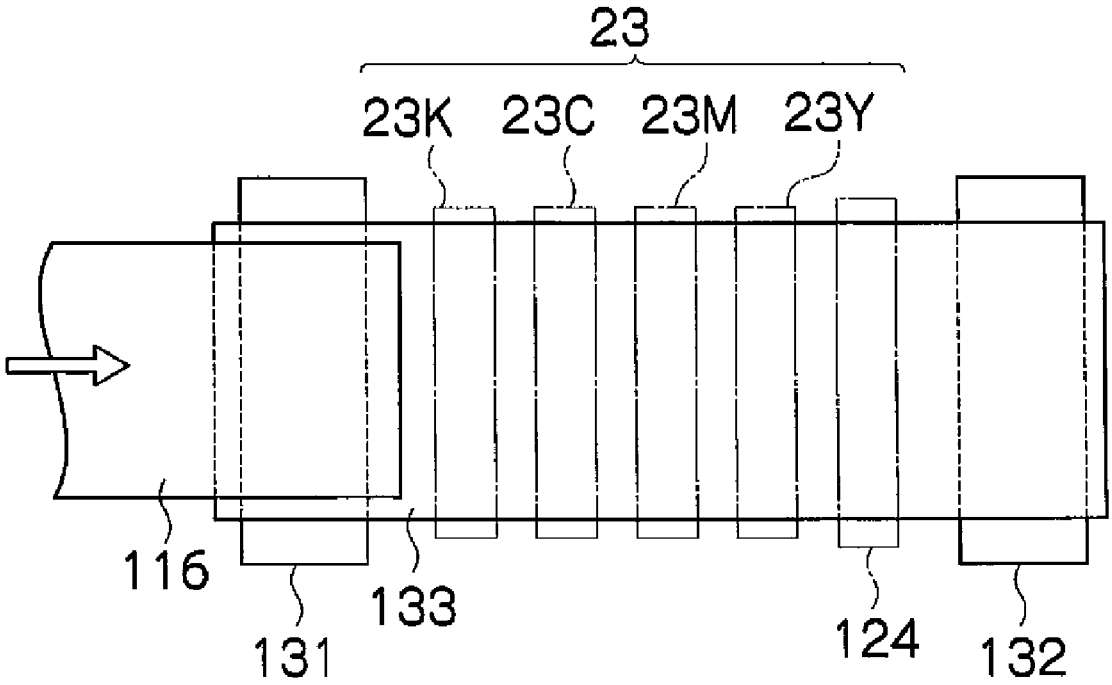
FIG. 14 is a plan view of the principal part of the peripheral area of a recording head in the inkjet recording apparatus illustrated in FIG. 13.

The recording heads 23K, 23C, 23M, and 23Y are full line recording heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 14).

The recording heads 23K, 23C, 23M and 23Y are arranged in color order (black (K), cyan (C), magenta (M), yellow (Y)) from the upstream side in the feed direction of the recording paper 116, and these recording heads 23K, 23C, 23M and 23Y are fixed extending in a direction substantially perpendicular to the conveyance direction of the recording paper 116.

A color image can be formed on the recording paper 116 by ejecting inks of different colors from the recording heads 23K, 23C, 23M and 23Y, respectively, onto the recording paper 16 while the recording paper 116 is conveyed by the belt conveyance unit 122.

By adopting a configuration in which the full line recording heads 23K, 23C, 23M and 23Y having nozzle rows covering the full paper width are provided for the respective colors in this way, it is possible to record an image on the full surface of the recording paper 116 by performing just one operation of relatively moving the recording paper 116 and the recording heads 23K, 23C, 23M and 23Y in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 shown in FIG. 13 has an image sensor (line sensor or area sensor) for capturing an image of the ink-droplet ejection result of the recording heads 23K, 23C, 23M and 23Y, and functions as a device to check for ejection defects such as clogs, landing position error, and the like, of the nozzles, from the ink-droplet ejection results evaluated by the image sensor.

A CCD area sensor in which a plurality of photoreceptor elements (photoelectric transducers) are arranged two-dimensionally on the light receiving surface is suitable for use as the print determination unit 124 of the present example. An area sensor has an imaging range which is capable of capturing an image of at least the full area of the ink ejection width (image recording width) of each of the recording heads 23K, 23C, 23M and 23Y. It is possible to achieve the required imaging range by means of one area sensor, or alternatively, it is also possible to ensure the required imaging range by combining (joining) together a plurality of area sensors. Alternatively, a composition may be adopted in which the area sensor is supported on a movement mechanism (not illustrated), and an image of the required imaging range is captured by moving (scanning) the area sensor.

Furthermore, it is also possible to use a line sensor instead of the area sensor. In this case, a desirable composition is one in which the line sensor has rows of photoreceptor elements (rows of photoelectric transducing elements) with a width that is greater than the ink droplet ejection width (image recording width) of the recording heads 23K, 23C, 23M and 23Y. A test pattern or the target image printed by the recording heads 23K, 23C, 23M, and 23Y of the respective colors is read in by the print determination unit 124, and the ejection performed by each recording head is determined. The ejection determination includes detection of the ejection, measurement of the dot size, and measurement of the dot formation position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 13, the paper output unit 126A for the target prints is provided with a sorter for collecting prints according to print orders.

Structure of the Recording Head

Next, the structure of a recording head 23 will be described.

Figure 15A:
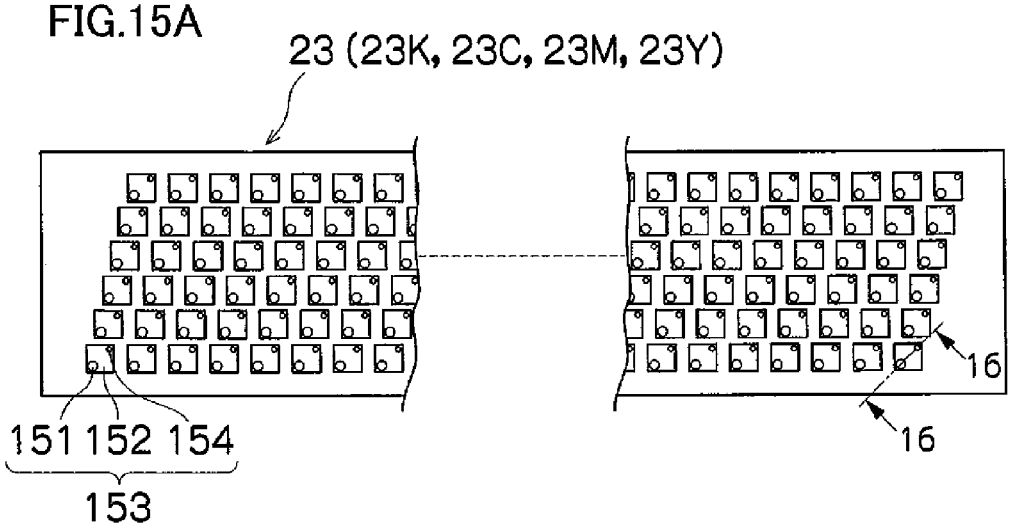
FIG. 15A is a plan view perspective diagram showing an example of the structure of a recording head.
Figure 15B:
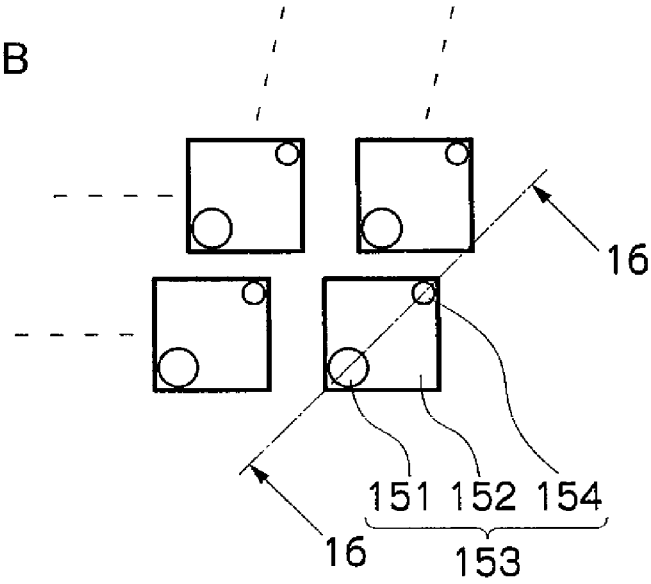
FIG. 15B is an enlarged view of a portion of FIG. 15A.
Figure 15C:
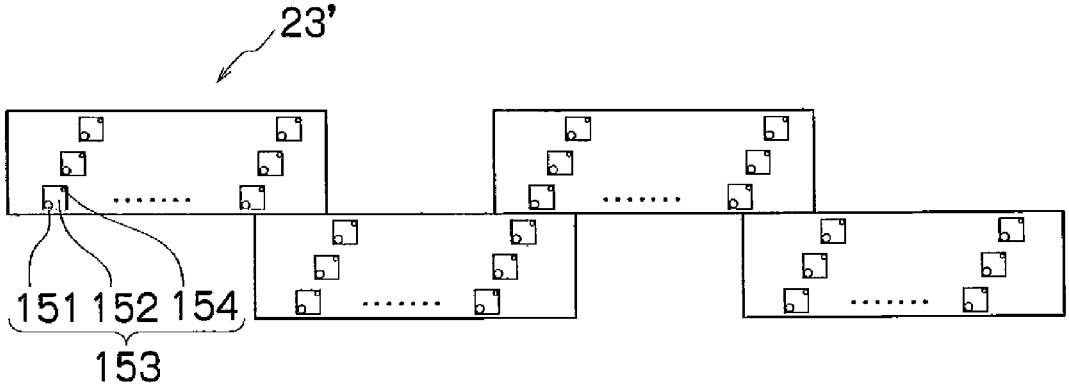
FIG. 15C is a plan view perspective diagram showing a further example of the structure of a full line head.
Figure 16:
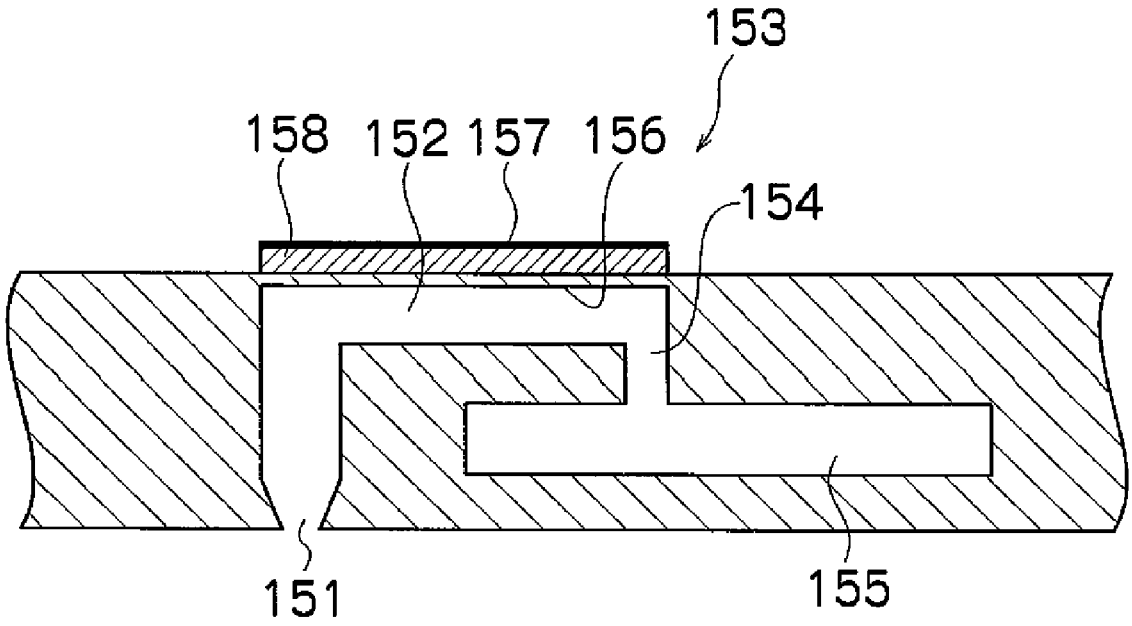
FIG. 16 is a cross-sectional view along line 16-16 in FIGS. 15A and 15B.

FIG. 15A is a perspective plan view showing an example of the configuration of the recording head 23, FIG. 15B is an enlarged view of a portion thereof FIG. 15C is a perspective plan view showing another example of the configuration of the recording head 23, and FIG. 16 is a cross-sectional view taken along the line 16-16 in FIGS. 15A and 15B, showing the inner structure of a droplet ejection element (an ink chamber unit for one nozzle 151).

The nozzle pitch in the recording head 23 should be minimized in order to maximize the density of the dots printed on the surface of the recording paper 116. As shown in FIGS. 15A and 15B, the recording head 23 according to the present embodiment has a structure in which a plurality of ink chamber units (droplet ejection elements) 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected in the lengthwise direction of the recording head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the example described above. For example, instead of the configuration in FIG. 15A, as shown in FIG. 15C, a line head having nozzle rows of a length corresponding to the entire width of the recording paper 116 can be formed by arranging and combining, in a staggered matrix, short recording head modules 23' having a plurality of nozzles 51 arrayed in a two-dimensional fashion.

As shown in FIGS. 15A and 15B, the planar shape of the pressure chamber 152 provided corresponding to each nozzle 151 is substantially a square, and an outlet to the nozzle, 151, is disposed in one of the two corners on a diagonal line of the square, while an inlet of supplied ink (supply port), 154, is disposed in the other of the two corners. The shape of the pressure chamber 152 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 16, each pressure chamber 152 is connected to a common channel 155 through the supply port 154. The common channel 155 is connected to the ink tank (not shown), which is a base tank that supplies ink, and the ink supplied from the ink tank is delivered through the common flow channel 155 to the pressure chambers 152.

Actuators 158 each provided with an individual electrode 157 are bonded to a pressure plate (a diaphragm that also serves as a common electrode) 156 which forms the surface of one portion (the ceiling in FIG. 16) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For the actuator 158, it is possible to adopt a piezoelectric element using a piezoelectric body, such as lead zirconate titanate or barium titanate. When the displacement of the actuator 158 returns to its original position after ejecting ink, the pressure chamber 152 is replenished with new ink from the common flow channel 155 through the independent supply port 154.

Figure 17:
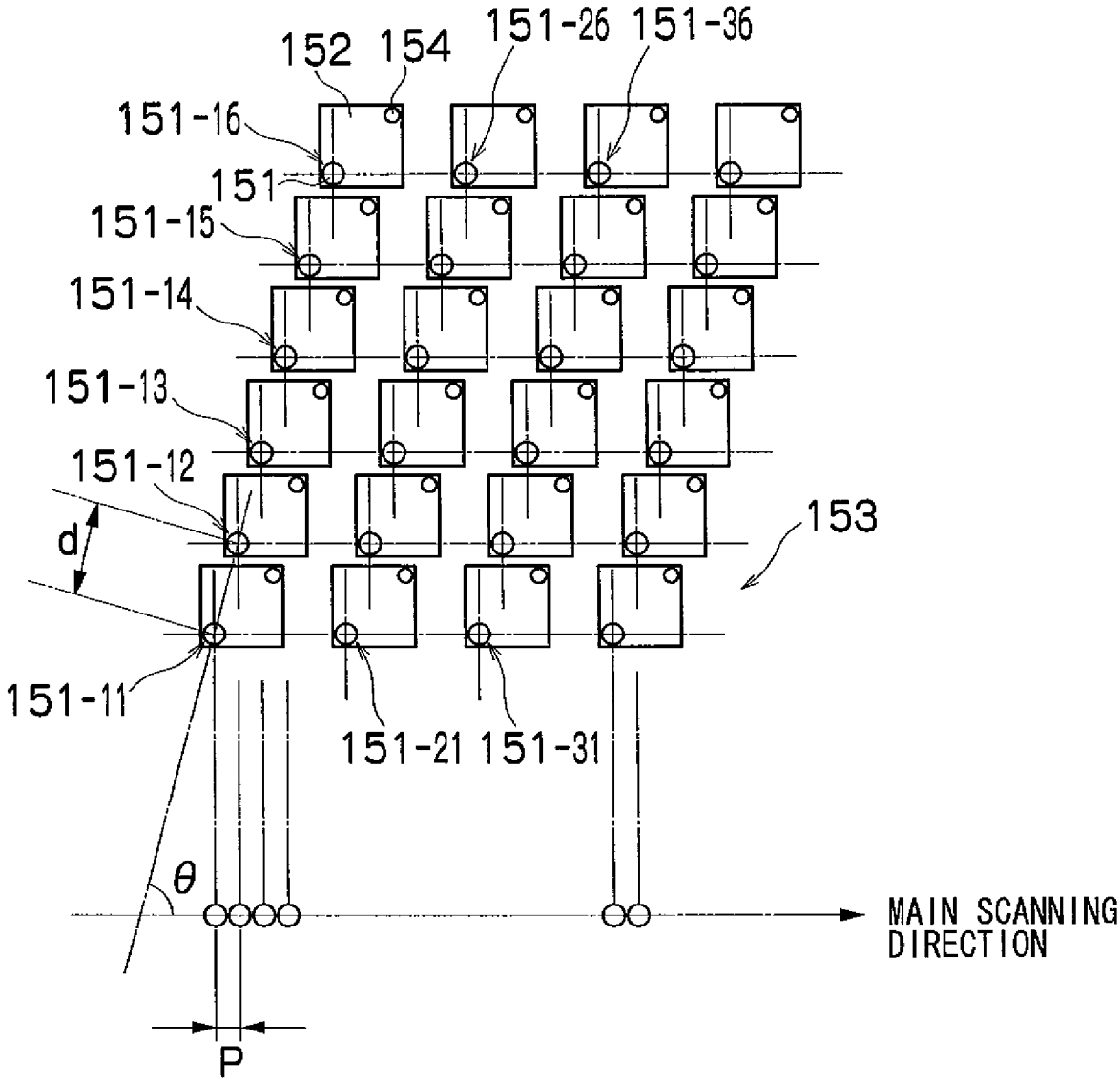
FIG. 17 is an enlarged view showing a nozzle arrangement in the recording head shown in FIG. 15A.

As shown in FIG. 17, the high-density nozzle head according to the present embodiment is achieved by arranging a plurality of ink chamber units 153 having the above-described structure in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction.

More specifically, by adopting a structure in which a plurality of ink chamber units 153 are arranged at a uniform pitch d in line with a direction forming an angle of $\theta$ with respect to the main scanning direction, the pitch P of the nozzles projected so as to align in the main scanning direction is $d \times \cos\theta$, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 17 are driven, the main scanning according to the above-described (3) is preferred. More specifically, the nozzles 151-11, 151-12, 151-13, 151-14, 151-15 and 151-16 are treated as a block (additionally; the nozzles 151-21, 151-22, . . . , 151-26 are treated as another block; the nozzles 151-31, 151-32, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator 158, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 18:
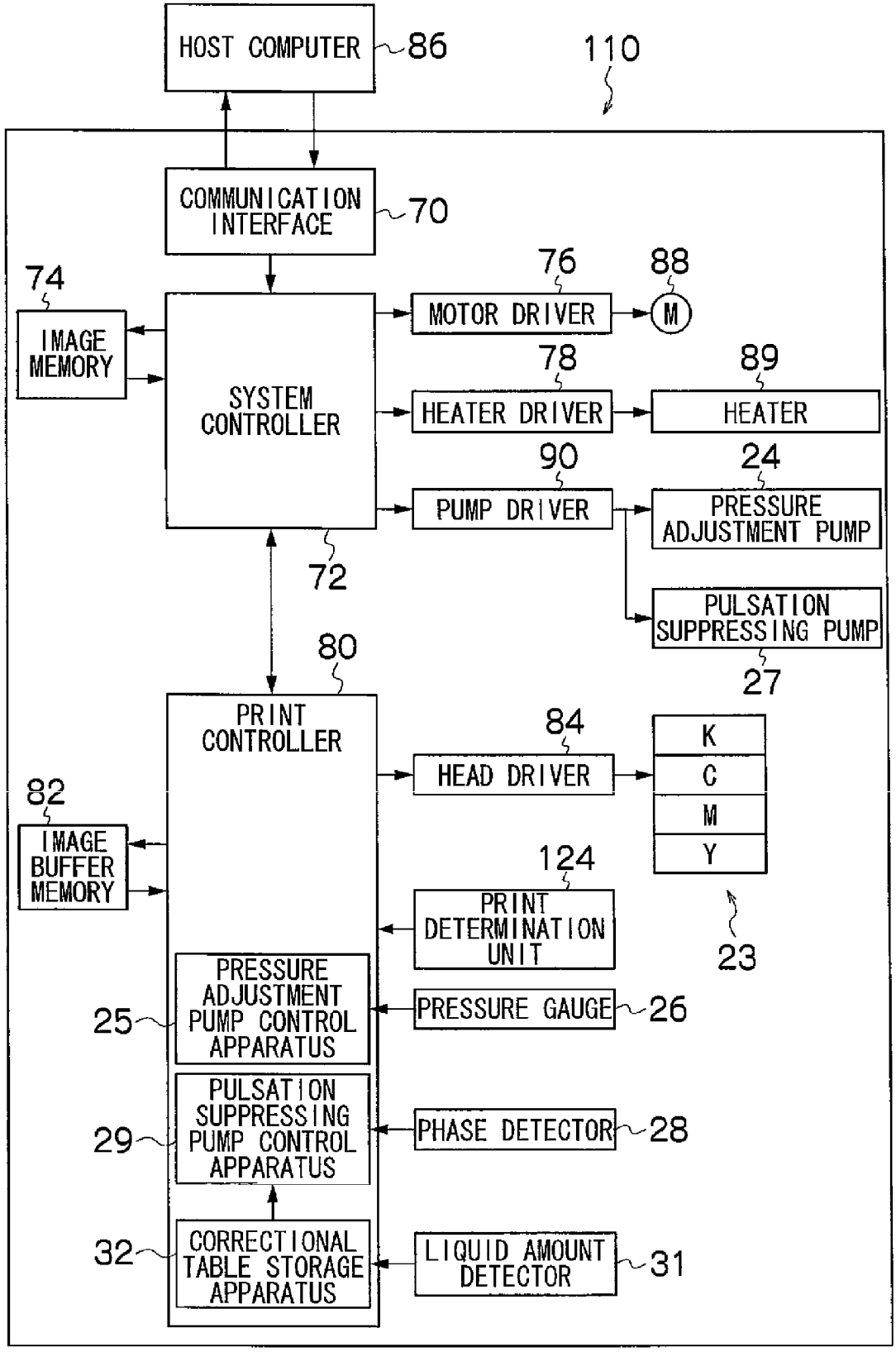
FIG. 18 is a principal block diagram showing the system configuration of an inkjet recording apparatus according to an embodiment of the present embodiment.
Figure 19:
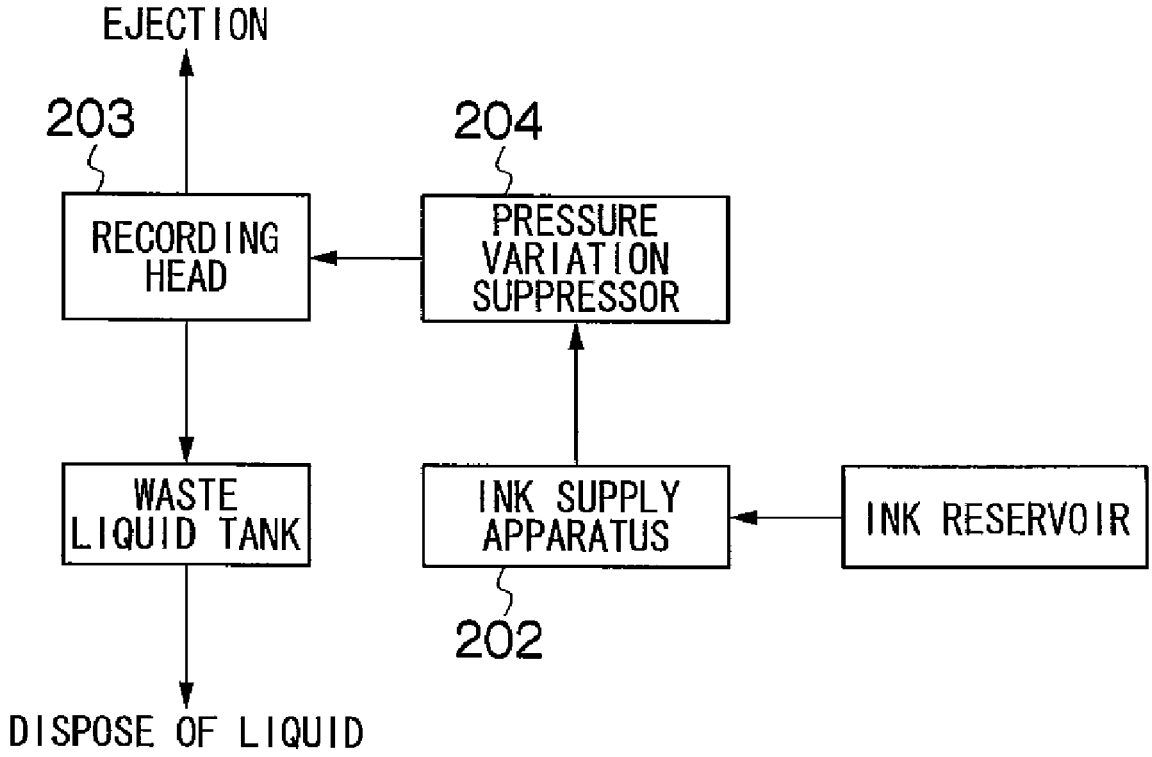
FIG.19 RELATED ART
FIG. 19 is a compositional block diagram of a recording apparatus which is disclosed in Japanese Patent Application Publication No. 2004-106310.
Figure 20:
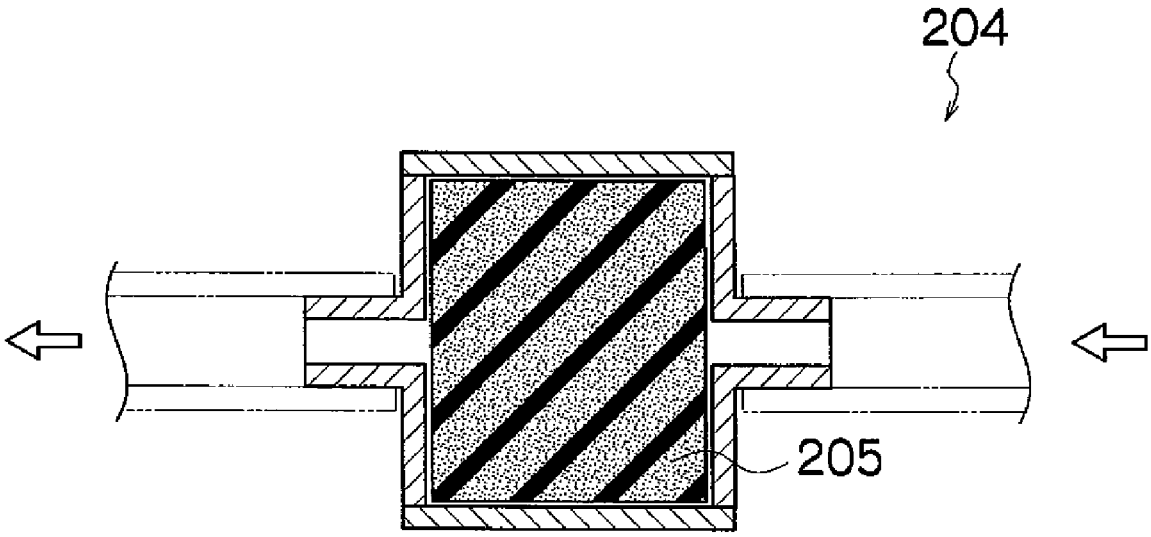
FIG.20 RELATED ART
FIG. 20 is a cross-sectional diagram of a pressure variation suppressor provided in the recording apparatus disclosed in Japanese Patent Application Publication No. 2004-106310.
Figure 21:
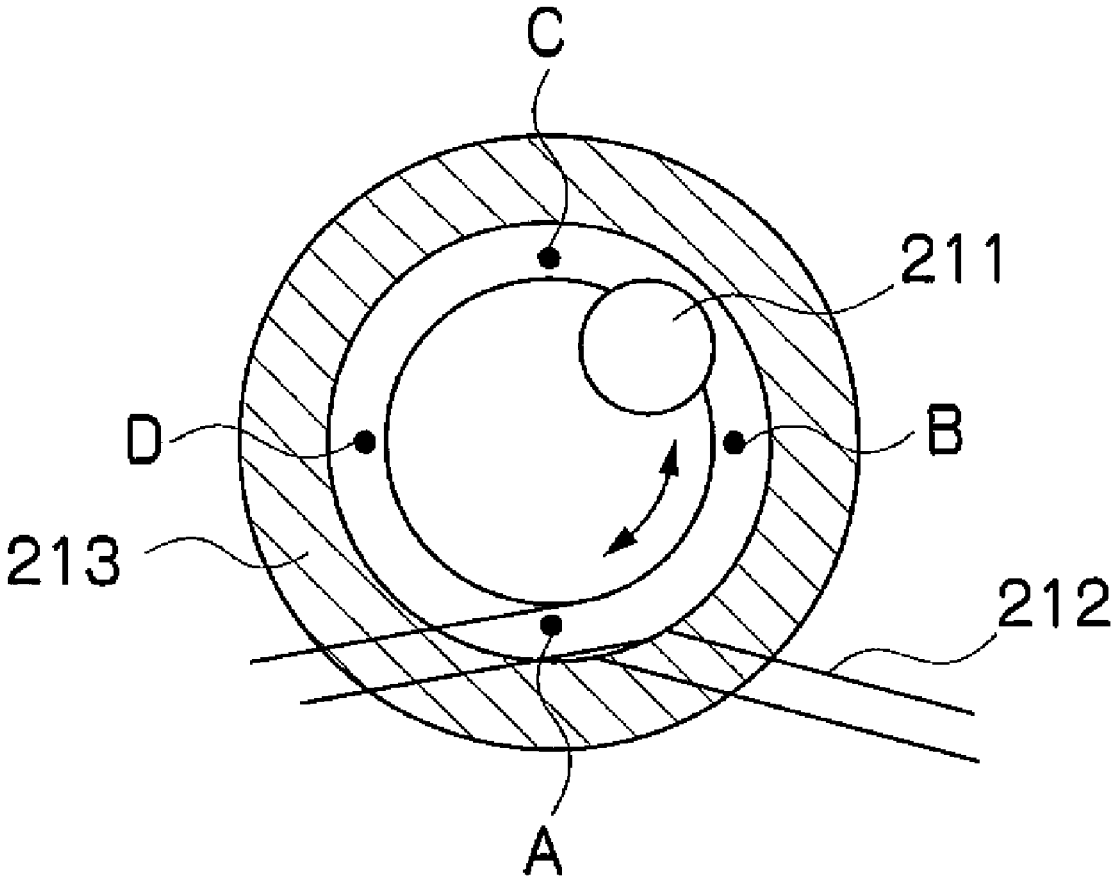
FIG.21 RELATED ART
FIG. 21 is a schematic drawing of a rotary pump.
Figure 22:
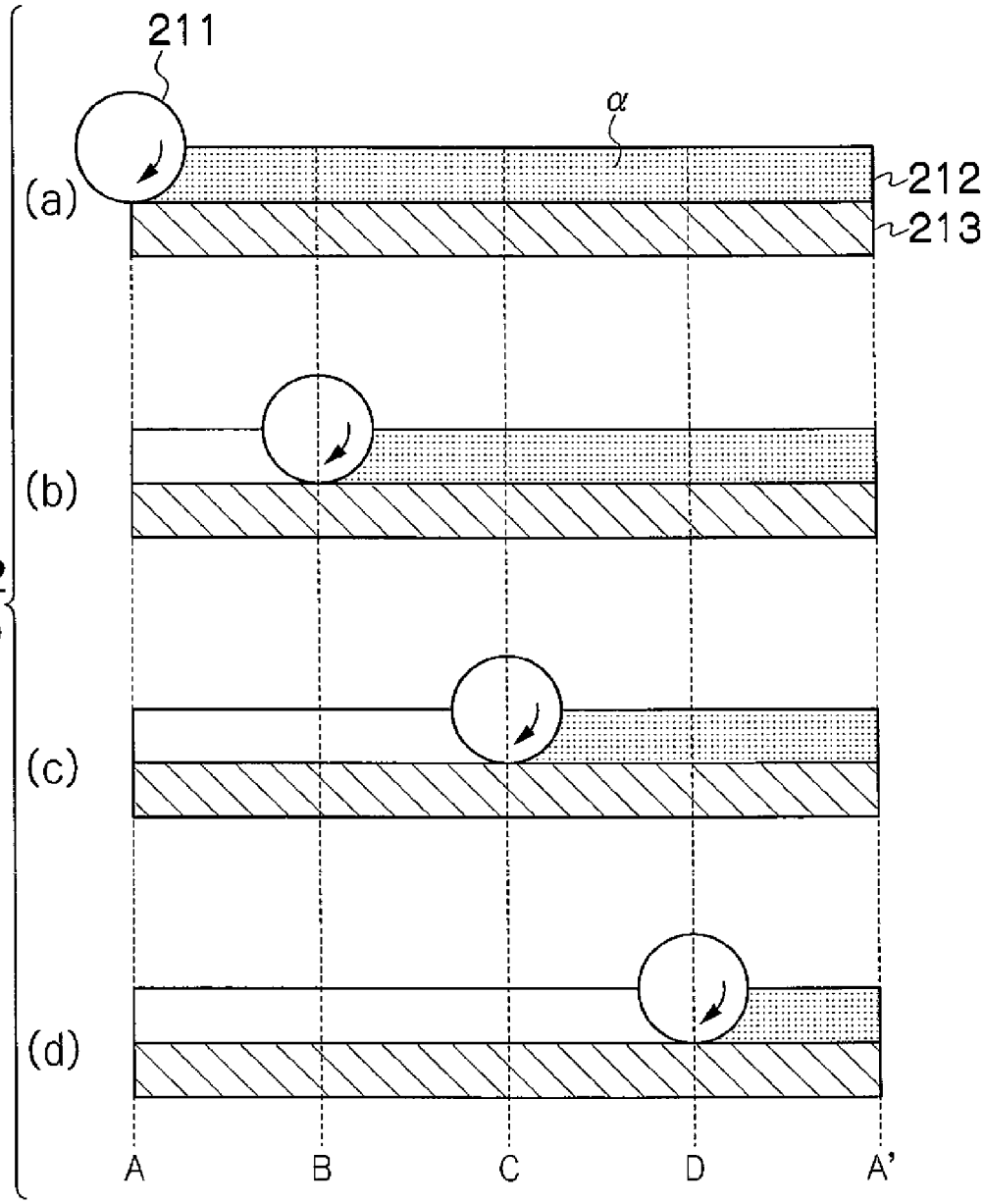
FIG.22 RELATED ART
FIG. 22 is an expanded diagram of the guide and the elastic tube shown in FIG. 21.
Figure 23:
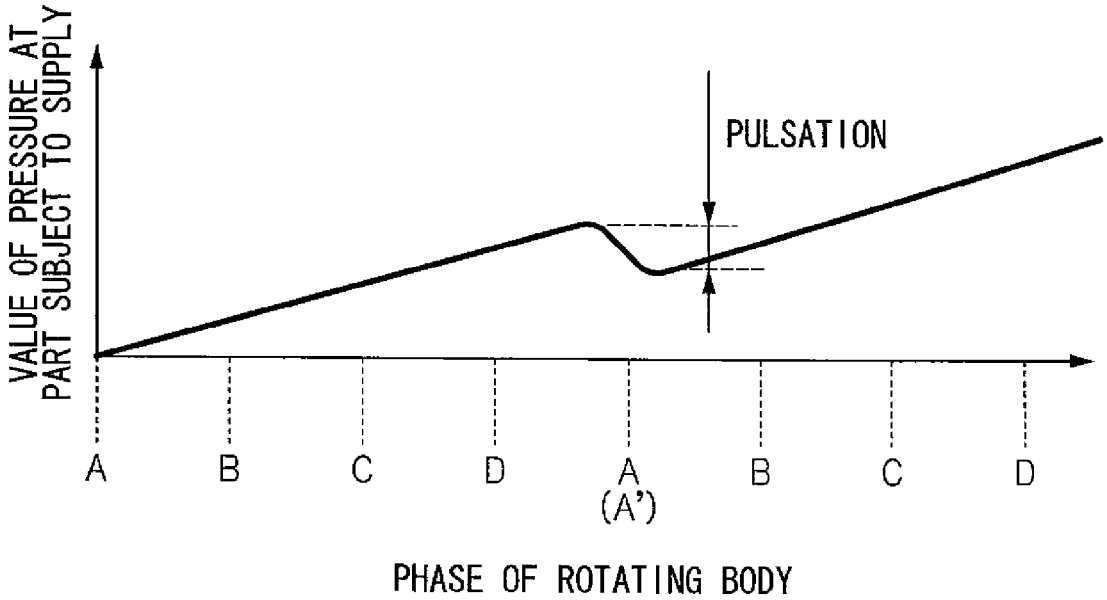
FIG.23 RELATED ART
FIG. 23 is an illustrative diagram of a pulsating action.

FIG. 18 is a block diagram showing a system configuration of the inkjet recording apparatus 110. As shown in FIG. 18, the inkjet recording apparatus 110 comprises a communication interface 70, a system controller 72, an image memory 74, a motor driver 76, a heater driver 78, a print controller 80, an image buffer memory 82, a head driver 84, pump driver 90, and the like.

The communication interface 70 is an interface unit (image input unit) which functions as an image input device for receiving image data sent from a host computer 86. A serial interface such as USB (Universal Serial Bus), IEEE 1394, Ethernet (registered trademark), wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 110 through the communication interface 70, and is temporarily stored in the image memory 74. The image memory 74 is a storage device for storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 110 in accordance with prescribed programs, as well as a calculation device for performing various calculations. More specifically, the system controller 172 controls the various sections, such as the communication interface 70, image memory 74, motor driver 76, heater driver 78, pump driver 90 and the like, as well as controlling communications with the host computer 86 and writing and reading to and from the image memory 74, and it also generates control signals for controlling the motor 88 of the conveyance system, a heater 89, the pressure adjustment pump 24, and the pulsation suppressing pump 27.

The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit 142 and the like in accordance with commands from the system controller 72. The pump driver 90 is a driver which drives the pressure adjustment pump 24 and the pulsation suppressing pump 27 in accordance with instructions from the system controller 72.

The print controller 80 functions as a signal processing device for performing various tasks, compensations, and other types of processing for generating droplet ejection control signals from the image data (multiple-value input image data) stored in the image memory 74 in accordance with commands from the system controller 72, and also functions as a drive control device for controlling the ejection driving of the recording heads 23 by supplying the generated ink ejection data to the head driver 84.

The print controller 80 is provided with the image buffer memory 82; and image data, parameters, and other data are temporarily stored in the image buffer memory 82 when image data is processed in the print controller 80. The aspect shown in FIG. 18 is one in which the image buffer memory 82 accompanies the print controller 80; however, the image memory 74 may also serve as the image buffer memory 82. Also possible is an aspect in which the print controller 80 and the system controller 72 are integrated to form a single processor.

A schematic processing flow from image input to printout shows that the image data to be printed is externally inputted through the communication interface 70, and is stored in the image memory 74. In this stage, for example, the RGB multiple-value image data is stored in the image memory 74.

The print controller 80 performs processing for converting the inputted RGB image data into dot data for four colors, K, C, M and Y. The dot data thus generated by the print controller 80 is stored in the image buffer memory 82. This dot data of the respective colors is converted into CMYK droplet ejection data for ejecting ink from the nozzles of the recording heads 23, thereby establishing the ink ejection data to be printed.

The head driver 84 outputs drive signals for driving the actuators 158 corresponding to the nozzles 151 of the recording heads 23 in accordance with the print contents, on the basis of the ink ejection data and the drive waveform signals supplied by the print controller 80. A feedback control system for maintaining constant drive conditions in the recording heads may be included in the head driver 84.

By supplying the drive signals output by the head driver 84 to the recording head 23, ink is ejected from the corresponding nozzles 151. By controlling ink ejection from the recording heads 23 in synchronization with the conveyance velocity of the recording paper 116, an image is formed on the recording paper 116.

As described above, the ejection volume and the ejection timing of the ink droplets from the respective nozzles are controlled via the head driver 84, on the basis of the ink ejection data and the drive signal wave (waveform) generated by implementing required signal processing in the print controller 80. By this means, desired dot sizes and dot positions can be achieved.

The print determination unit 124 is a block that includes the image sensor as described above with reference to FIG. 13, reads the image printed on the recording paper 116, performs required signal processing, and the like, to determine the print conditions (presence of the ejection, variation in the dot formation, optical density, and the like), and provides the determination results of the print conditions to the print controller 80 and system controller 72.

A pressure adjustment pump control apparatus 25 is provided in the print controller 80, which generates a control signal for driving the pressure adjustment pump 24 on the basis of the pressure value of the ink as determined by the pressure gauge 26, and supplies this control signal to the system controller 72.

A pulsation suppressing pump control apparatus 29 is provided in the print controller 80, which generates a control signal for driving the pulsation suppressing pump 27 on the basis of the phase value determined by the phase detector 28, and supplies this control signal to the system controller 72.

As described in relation to the second embodiment, it is possible to provide a correctional table storage apparatus 32 in the print controller 80, and to generate a correctional value for the control signal which is used to drive the pulsation suppressing pump 27 on the basis of the value of the amount of liquid determined by the liquid amount detector 31, this correctional value being supplied to the pulsation suppressing pump control apparatus 29.

The present invention is not limited to a line head type of printer, and it may also be applied to a shuttle scanning type of printer.

Liquid ejection apparatuses and recording apparatuses according to the present invention are described in detail above, but the present invention is not limited to these examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus comprising:

a recording head which ejects an ejection liquid;

a liquid container which accommodates air and the ejection liquid;

a recording bead connection flow channel which leads from the liquid container to the recording head;

a pressure determination device which determines pressure of the ejection liquid accommodated in the liquid container;

a first pressure supply device which drives a rotating body to remove or introduce the air from or to the liquid container so as to keep pressure of the air in the liquid container constant;

a phase determination device which determines a phase of the rotating body;

a second pressure supply device which is disposed in a pulsation suppressing flow channel that connects the liquid container with the recording head connection flow channel and which removes and introduces the ejection liquid from or to the liquid container; and a control device which controls rotation speed of the second pressure supply device in accordance with the phase of the rotating body determined by the phase determination device so as to cancel out variation of the pressure of the ejection liquid caused by the first pressure supply device.

2. The liquid ejection apparatus as defined in claim 1, further comprising a liquid amount detector which determines an amount of the ejection liquid accommodated in the liquid container, wherein the control device alters an amount of the ejection liquid removed from or introduced to the liquid container in accordance with the amount of the ejection liquid determined by the liquid amount detector to cancel out the variation of the pressure of the ejection liquid caused by the first pressure supply device.

3. The liquid ejection apparatus as defined in claim 1, wherein during not recording, the second pressure supply device is driven to circulate the ejection liquid through the liquid container, the recording head connection flow channel and the pulsation suppressing flow channel.

4. A recording apparatus comprising the liquid ejection apparatus as defined in claim 1.

* * * * *